United States Patent [19]

Bachmann

[11] Patent Number: 4,890,861

[45] **Date of Patent: * Jan. 2, 1990**

[54] WING APPARATUS FOR SKIERS

[76] Inventor: William V. Bachmann, 22517 Ten Mile Rd., St. Clair Shores, Mich. 48080

[ * ] Notice: The portion of the term of this patent subsequent to Jul. 12, 2005 has been disclaimed.

[21] Appl. No.: 215,526

[22] Filed: Jul. 6, 1988

Related U.S. Application Data

[63] Continuation-in-part of Ser. No. 12,659, Feb. 9, 1987, Pat. No. 4,756,555.

[51] Int. Cl.[4] ..... A63C 11/00

[52] U.S. Cl. ..... 280/810; 280/816; 280/819; 244/4 A; 224/222; 267/154

[58] Field of Search ..... 280/809, 810, 816, 819; 180/2.2, 180; 114/39.2; 244/4 A, 64, 151, 900; 224/209, 210, 211, 222, 257, 258, 259, 261, 262; 267/154, 276, 279

[56] References Cited

U.S. PATENT DOCUMENTS

| | | | |
|---|---|---|---|
| 95,513 | 10/1869 | Quinby | 244/64 |
| 132,022 | 10/1872 | Quinby | 244/64 |
| 279,706 | 6/1883 | Carroll | 224/258 |
| 1,012,767 | 12/1911 | Vize | 244/64 |
| 1,178,165 | 4/1916 | Lupton, Jr. | 280/810 |
| 1,723,147 | 8/1929 | Fourethier | 224/211 X |
| 1,773,921 | 8/1930 | McKinney | 244/64 |
| 1,859,178 | 5/1932 | Sprinkle | 280/810 |
| 2,213,754 | 9/1940 | Thirring | 280/810 |
| 3,047,302 | 7/1962 | Krylov | 280/810 |
| 3,437,348 | 4/1969 | Biabaud | 267/276 X |
| 3,830,512 | 8/1974 | Spiegel | 280/810 |
| 3,924,870 | 12/1975 | Spivack et al. | 280/810 |
| 4,204,694 | 5/1980 | Freeman | 280/810 |
| 4,311,324 | 1/1982 | Fries | 280/810 |
| 4,531,763 | 7/1985 | Toland | 280/810 |
| 4,756,555 | 7/1988 | Bachmann | 280/810 |

FOREIGN PATENT DOCUMENTS

| | | | |
|---|---|---|---|
| 0169440 | 11/1951 | Austria | 280/810 |
| 222136 | 5/1906 | Fed. Rep. of Germany | 244/64 |
| 2310563 | 7/1974 | Fed. Rep. of Germany | 280/810 |
| 1528013 | 6/1968 | France | 280/810 |
| 2515136 | 4/1983 | France | 114/39.2 |

OTHER PUBLICATIONS

"Popular Mechanics", magazine article: "Austrian's Ski-Sail Permits Long Leaps", Jan., 1953, p. 155.

Book, "Der Schwelzbelauf", Hans Thirring, Copyright 1939 (Germany), cover pages and p. 16.

"Skiing" Magazine; Oct., 1986, p. 19.

"Manbirds", Maralys Wills; Prentice Hall, Inc., cover pages and p. 43; publication date unknown.

*Primary Examiner*—Charles A. Marmor
*Assistant Examiner*—Brian P. Johnson
*Attorney, Agent, or Firm*—Lon H. Romanski

[57] ABSTRACT

Apparatus for creating aerodynamic lift to a downhill skier is shown as having a harness adapted to be worn by the skier, a left wing structure is operatively carried by the harness, a right wing structure is operatively carried by the harness, the left wing structure has a first longitudinal axis extending generally transversely of the skier, the right wing structure has a second longitudinal axis extending generally transversely of the skier, the left wing structure is selectively rotatable about the first longitudinal axis, the right wing structure is selectively rotatable about the second longitudinal axis, and the left and right wing structures are respectively rotatable about the first and second axes independently of each other by the skier to respective selected positions, and batten-like members are provided to enhance the airfoil configuration of the wing structures.

37 Claims, 14 Drawing Sheets

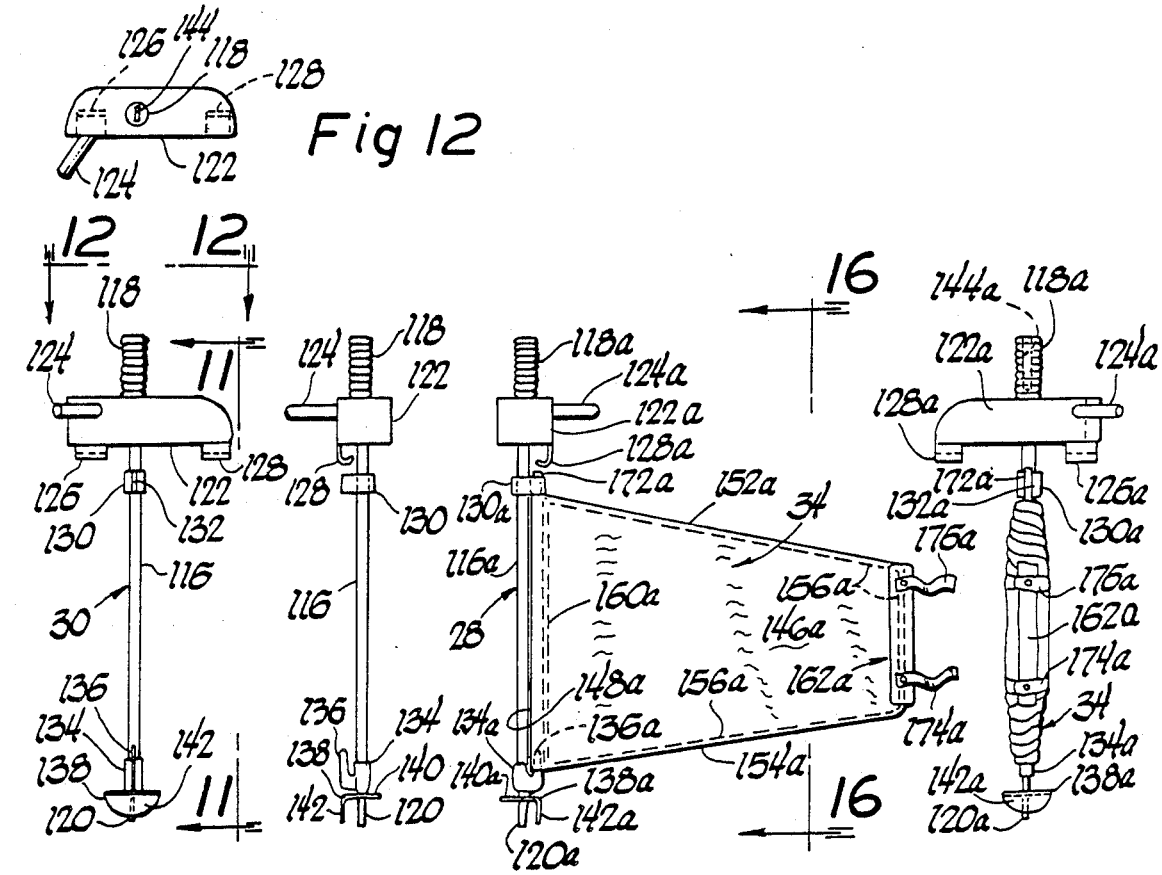
Fig 12
Fig 10
Fig 11
Fig 15
Fig 16
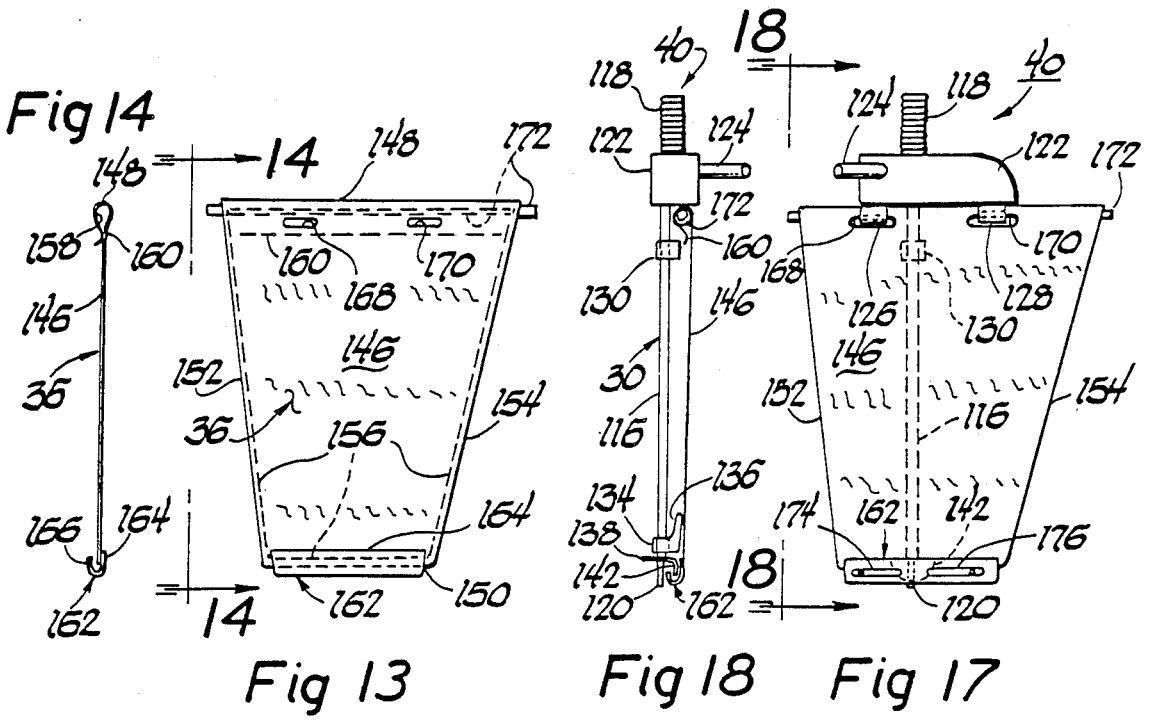
Fig 14
Fig 13
Fig 18
Fig 17

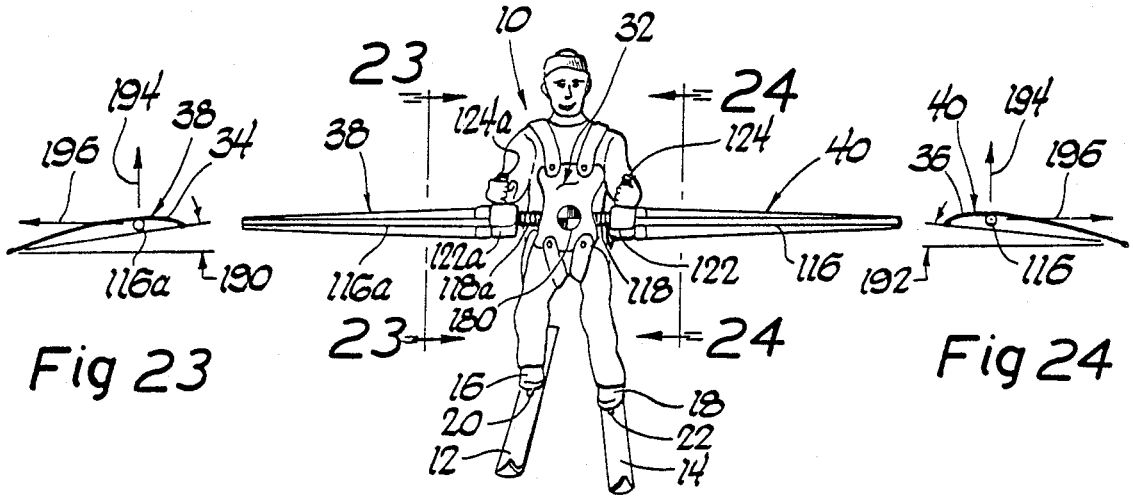
Fig 23
Fig 24
Fig 22
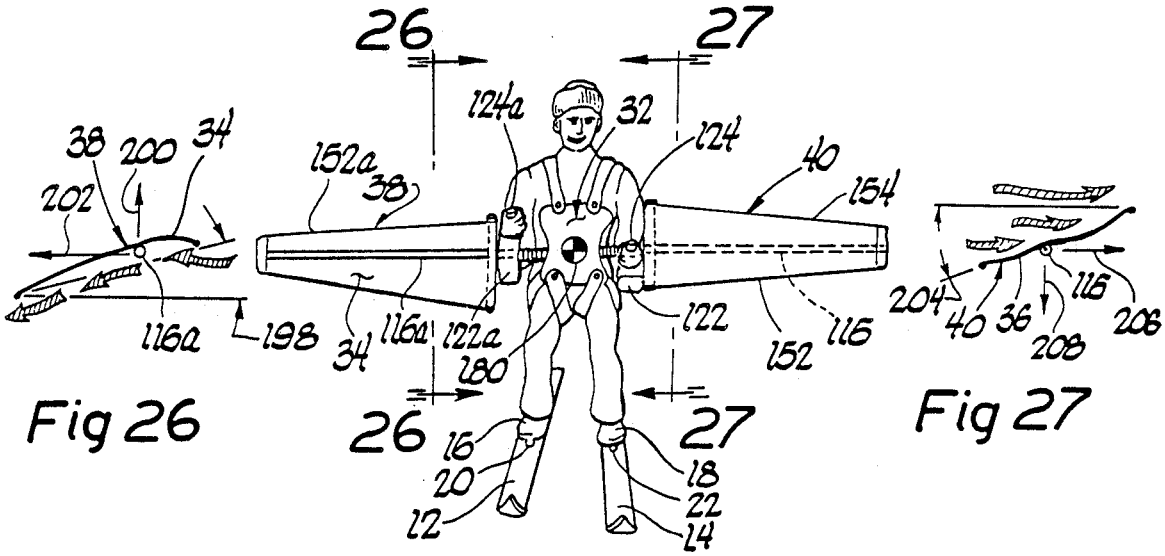
Fig 26
Fig 27
Fig 25

WING APPARATUS FOR SKIERS

RELATED APPLICATION

This is a Continuation-in-Part of my copending application Ser. No. 012,659 filed Feb. 9, 1987, now U.S. Pat. No. 4,756,555 for "Wing Apparatus for Skiers".

FIELD OF THE INVENTION

This invention relates generally to wing apparatus primarily for use by snow skiers and more particularly by alpine or downhill skiers for achieving, among other things, the sensation of flying without the necessity of having the skier's skis lose contact with the ground snow.

BACKGROUND OF THE INVENTION AND PRIOR ART STATEMENT

Heretofore, the prior art has made many attempts to provide various forms of apparatus employable in the sports of skiing and/or skating for using or creating some aerodynamic lifting and/or braking forces or effects. Some of such prior art apparatus or devices were intended to be employable in both of such sports. For example, various forms of sail devices have been suggested whereby either the skater or skier would be propelled by the wind. Obviously, with such prior art devices, employed for using the wind to propel the skier and/or skater, no aerodynamic lift could be produced.

U.S. Pat. No. 1,178,165 dated Apr. 4, 1916, and issued to B.M. Lupton Jr., discloses an appliance comprised of generally triangular sail panels which are adapted to be secured to the skater's body as to have, in each sail, the shorter edge of the sail panel extending from a point adjacent the skater's body to the skater's hand or wrist while the longer edge of the sail panel extends downwardly from the shorter edge to an area of the skater's ankle to which the sail panel is secured thereby resulting in a flexible bat-like triangular wing panel (or panels) whenever the skater extends an arm (or arms).

U.S. Pat. No. 1,859,178 dated May 17, 1932, and issued to S.A. Sprinkle, discloses a hand-held (folding) T-shaped main frame on which a triangular sail is mounted. After assembly, a skater obtains a wind propelling force as by holding the sail assembly along and on the windward side of the skater's body.

U.S. Pat. No. 3,047,302 dated July 31, 1962, and issued to C.A. Krylov, discloses another form of hand-held apparatus comprising a propeller like structure which is hand-held, as by the skier, to be forwardly of the skier.

U.S. Pat. No. 3,924,870 dated Dec. 9, 1975, and issued to Mayer Spivack et al, discloses another form of hand-held sail for use by a skater in obtaining a wind driven propelling force.

U.S. Pat. No. 4,204,694 dated May 27, 1980, and issued to J.L. Freeman, discloses two types of mast-carried sails for use by any of a skier, skater or iceboater for obtaining a wind driven propelling force. One of such sails is of the lateen configuration while the other is comprised of separate forward and aft sails each of which is operatively connected to a generally horizontally extending spar. The mast, in either case, can be supported as on one ski of a skier's pair of skis, on one skating shoe assembly of a skater's pair of skating shoe assemblies, or on apparatus defining an iceboat.

U.S. Pat. No. 4,311,324 dated Jan. 19, 1982, issued to J.E. Fries, illustrates an appliance not unlike that disclosed by said U.S. Pat. No. 1,178,165 to Lupton, Jr. (cited as a prior art reference). In this U.S. Pat. No. 4,311,324 the generally triangular panels, while being secured at their respective lower apexes to the skater's ankles, are carried at their upper edges by common pole means which the skater, in turn, holds in an upper disposed generally horizontal position. Again, this device is employed by the skater for obtaining a wind driven propelling force.

Other prior art devices have been proposed primarily for use in the sport of skiing and such were, for all practical purposes, limited in use to downhill runs. In the main, such devices were various forms of sails to be used by the skier as aerodynamic braking means.

U.S. Pat. No. 2,213,754 dated Sept. 3, 1940, and issued to H. Thirring, discloses a cloak-like garment secured along the arms and legs of the skier and so shaped that, as seen from the front, when the skier stretches-out his arms laterally a trapezoidal or triangular air baffle sail is spread out between the skier's hands and legs with the hands still being free to hold the ski poles.

U.S. Pat. No. 3,830,512 dated Aug. 20, 1974, and issued to Bernt Spiegel, discloses a fabric-like braking sail of a generally convex top and side edges and arranged so that the baffle-like sail is arched substantially spherically by air flow with the greatest bulge in the lower portion. The sail is provided with handles at its upper corners, for gripping by the skier's hands, and detachable latches at the lower corners for attachment to the skis or boots of a skier.

U.S. Pat. No. 4,531,763 dated July 30, 1985, and issued to D.A. Toland, discloses an aerodynamic braking sail-like device having halves of equal area which are symmetrical about a central vertical axis and are balanced when held in the apparent wind created during a skier's downhill run. The sail has straight outer edges remote from the axis and hems along the edges forming sheaths to receive ski poles or the like. The sheaths leave central areas in which the ski poles can be gripped and the position of the grips is such that the areas above and below the line of the grips are equal so that the skier can effect counterbalancing of the apparent wind forces above and below the line. Indented pockets or balloon areas are intended to enhance the braking effect and provide more effective balance and speed control. In use, the sail is held taut between the skier's outstretched hands and, with the counterbalancing of the forces and ease of manipulation of the sail, easy and effective control of the skier's descent is said to be accomplished.

French Pat. No. 1,528,013 granted Apr. 29, 1968 (published June 7, 1968), to M. Dupuy discloses a baffle-like wing device for a braking effect. The device comprises generally laterally and vertically extending wing-like portions which are grasped at their upper ends by the skier's hands while a lower disposed medially situated portion is secured as by a belt, or the like, to the skier's waist. The wing-like portions, along their outer side edges, taper generally from a widest portion near the upper ends to a narrowest portion near the lower ends at a distance considerably below the skier's waist.

On page 19 of the Oct., 1986, issue of "Skiing" Magazine bearing a U.S.A. copyright notice of 1986 by CBS Magazines, a Division of CBS, Inc. (having an address of: 3460 Wilshire Blvd., Los Angeles, Calif.) a photograph and an accompanying brief statement appear relating to a "Ski Wings" invented by one David Toland. As stated therein, the device is intended to provide air cushion cruise control (air braking) for downhill runs. The structure, as understood, is not unlike the other prior art structures hereinbefore discussed.

The foregoing group of prior art patents, starting with said Pat. No. 2,213,754, disclose apparatus or devices principally suitable for only one purpose, that being, to serve as an aerodynamic brake to help slow a fast-running downhill skier. However, such aerodynamic braking devices are inconvenient in use, not significantly effective for their intended purpose and, further, they interfere with or even prevent the skier from executing various interesting and pleasurable skiing movements and techniques.

The prior art has also, heretofore, proposed various apparatus and devices for having a skier achieve flight while wearing skis.

Austrian Pat. No. 169,440 dated Nov. 10, 1951, and issued to N. Martinak, discloses apparatus, intended for creating flight, comprising two triangular fabric wing-like panels laterally spaced from each other and interconnected at their inner apexes as by belt or strap means. The outer-most edges of the wing-like panels are of sheath-like configuration which respectively accept the skier's ski poles. It is asserted, by said N. Martinak, that when the skier, thusly equipped, holds his arms outstretched while still holding the ski poles aerodynamic lift can be achieved. However, this, as a practical matter is unattainable because, first, the total area of the wing-like panels would be too small to create any significant aerodynamic lift and, second, the magnitude of the resulting torque applied to the skier's outstretched arms would be unbearable to the skier. Further, to require the skier, as such apparatus does, to ski with his arms outstretched and holding ski poles is contrary to any useful skiing technique.

German patent document (Offenlegungsschrift) 2,310,563 published Sept. 5, 1974, of Gerhard Hanik, discloses a multi-wing structure to be worn on the upper back of a skier's body. The overall structure may have from two to fifteen load-bearing wing-like members secured to an intermediate attachment frame which has a general contour of a butterfly with spread wings. Such attachment frame is secured to the skier's back at an area near the skier's shoulders as to have at least certain of the wing-like members at an elevation at least above shoulder height. It is intended that in use the skier must lean significantly forward, at the waist, to thereby expose all of the wing-like members to the apparent wind. Even assuming that such an apparatus would be functional, the skier, wearing a cluster of small wing-like members situated generally above him (while leaning forwardly), will hardly feel comfortable or natural in his skiing techniques and maneuvers.

In a book entitled "Der Schwebelauf" (The Soaring Run), authored by Dr. Hans Thirring and bearing a copyright notice of 1939 in Germany, describes a real wing structure of dimensions large enough for actually lifting a skier, employing such a wing structure, off the ground. However, with such a wing structure once the skier was airborne the skier could not control the wing as to assure either a stable flight or a safe landing.

In a publication "Manbirds" (Hang Gliders & Hang Gliding) published by Prentice-Hall, Inc. of Englewood, N.J., U.S.A., there is a photograph, and brief written description, of one Willie Muller who in 1971 combined skiing with hang gliding. As a consequence of such a general arrangement, the skier could take-off from a steep slope and be airborne. However, for so long as the skier was airborne, the skier could not use his skiis and therefore during such time was not actually engaged in skiing but rather in airborne gliding. After landing, a skier, employing such a hang glider, is presented with the problem of having to somehow transport the hang glider (which may weigh 80 lbs.) back-up the snow-covered hill.

As discussed, such prior art devices can be broadly grouped into two categories the first being that group or category in which the wing structure, although making the skier airborne, provides no means by which the skier can control the wing structure as to assure either a stable flight or a safe landing. The second group or category would include devices as the hang glider wing structures which do provide for control by the skier to, at least to a significant degree, assure stable flight and a safe landing. However, among other problems attendant such prior art structures, in both categories the skier, while airborne, is not actually skiing. Further while employing such prior art wing structures it is a practical impossibility for a skier to actually ski in any normal fashion.

SUMMARY OF THE INVENTION

In one aspect of the invention, apparatus for creating aerodynamic lift to a downhill skier comprises harness means adapted to be worn by said skier, a left wing structure operatively carried by said harness means, a right wing structure operatively carried by said harness means, said left wing structure having a first longitudinal axis extending generally transversely of said skier, said right wing structure having a second longitudinal axis extending generally transversely of said skier, wherein said left wing structure is selectively rotatable about said first longitudinal axis, wherein said right wing structure is selectively rotatable about said second longitudinal axis, and wherein said left and right wing structures are respectively rotatable about said first and second axes independently of each other by said skier to respective selected positions, wherein each of said left and right wing structures comprises flexible panel material, and further comprising means for performing an airfoil configuration into said flexible panel material.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views;

FIG. 10 is an elevational view of one of the elements shown in FIGS. 2 and 3 and more particularly identified as the skier's left hand ski pole embodying teachings of the invention;

FIG. 11 is a view, of the ski pole of FIG. 10, taken generally on the plane of line 11—11 of FIG. 10 and looking in the direction of the arrows;

FIG. 12 is a view taken generally on the plane of line 12—12 of FIG. 10 and looking in the direction of the arrows;

FIG. 13 is what may be considered a top plan view of a wing sub-assembly, embodying teachings of the invention, intended for use as a skier's left wing panel;

FIG. 14 is a view taken generally on the plane of line 14—14 of FIG. 13 and looking in the direction of the arrows;

FIG. 15 is what may be considered a bottom plan view of a wing sub-assembly, embodying teachings of the invention and intended for use as a skier's right wing panel with such being shown operatively connected at its inner end, as at the initiation of its stored condition, to the skier's right hand ski pole, shown in elevation, and also employing teachings of the invention;

FIG. 16 is a view of the ski pole of FIG. 15 taken generally on the plane of line 16—16 of FIG. 15 and with the ski wing panel of FIG. 15 being totally wrapped about such ski pole as to be in its fully stored condition on the ski pole;

FIG. 17 is a view of the ski pole shown in FIG. 10 with the wing panel means of FIG. 13 secured thereto as to form an operational wing assembly;

FIG. 18 is a view taken generally on the plane of line 18—18 of FIG. 17 and looking in the direction of the arrows;

FIG. 22 is a front elevational view of a skier as shown in FIG. 4 except that the skier in FIG. 22 is depicted as having selectively manually adjusted both the left and right (skier's left and right) wing structures, embodying teachings of the invention, as to have each at generally the same positive angle of attack as to thereby achieve generally equal aerodynamic lift on both of such wing structures;

FIG. 23 is a cross-sectional view taken generally on the plane of line 23—23 of FIG. 22 and looking in the direction of the arrows;

FIG. 24 is a cross-sectional view taken generally on the plane of line 24—24 of FIG. 22 and looking in the direction of the arrows;

FIG. 25 is a view similar to that of FIG. 22 except that in FIG. 25 the skier is depicted as having adjusted the skier's right wing structure to a substantially increased angle of attack and as having adjusted the skier's left wing structure as to have the leading edge thereof lowered to an elevation substantially lower than the trailing edge of such left wing structure;

FIG. 26 is a cross-sectional view taken generally on the plane of line 26—26 of FIG. 25 and looking in the direction of the arrows;

FIG. 27 is a cross-sectional view taken generally on the plane of line 27—27 of FIG. 25 and looking in the direction of the arrows;

DETAILED DESCRIPTION OF THE PREFERRED EMBODIMENTS

Figure 1:
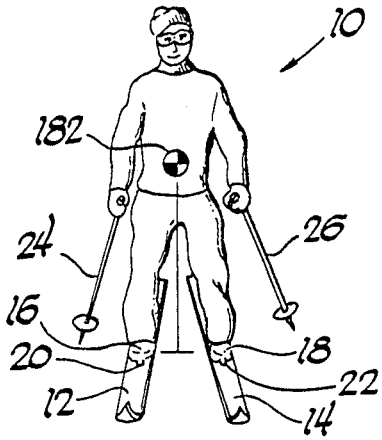
Fig 1 PRIOR ART
FIG. 1 is a front elevational view of a skier with conventional or prior art equipment.

Referring now in greater detail to the drawings, FIG. 1 illustrates a skier 10 employing, exclusively, prior art downhill type skiing equipment as, for example, right and left skis 12 and 14, right and left ski boots 16 and 18, right and left ski boot bindings 20 and 22 and right and left ski poles 24 and 26. (By way of clarification, and except as specifically noted to the contrary, the terms "right" and "left" as used herein refer to the skier's right and left. Further, like elements in the various Figures are identified with like reference numbers.)

Figure 2:
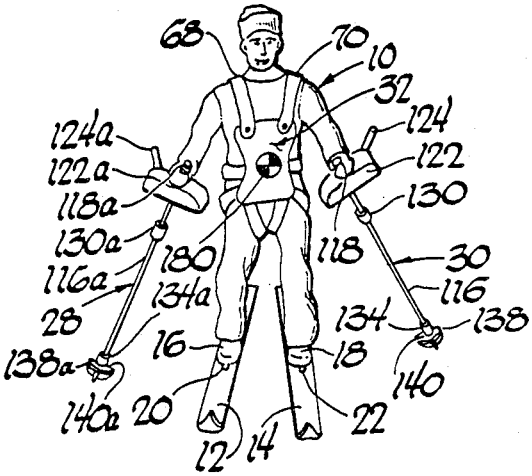
FIG. 2 is a front elevational view of a skier equipped with apparatus employing teachings of the invention.

In comparison, FIG. 2 depicts the same skier 10 but equipped with some of the prior art structure shown in FIG. 1 and equipped with apparatus employing teachings of the invention. More particularly, in FIG. 2, the skier 10 is employing a right ski pole assembly 28 and a left ski pole assembly 30, each employing teachings of the invention, and is wearing a harness assembly 32 which also employs teachings of the invention. As should be apparent, the skier 10 of FIG. 2, with the equipment and apparatus depicted therein, is still able to complete skiing maneuvers as when equipped with exclusively the prior art apparatus of FIG. 1.

Figure 3:
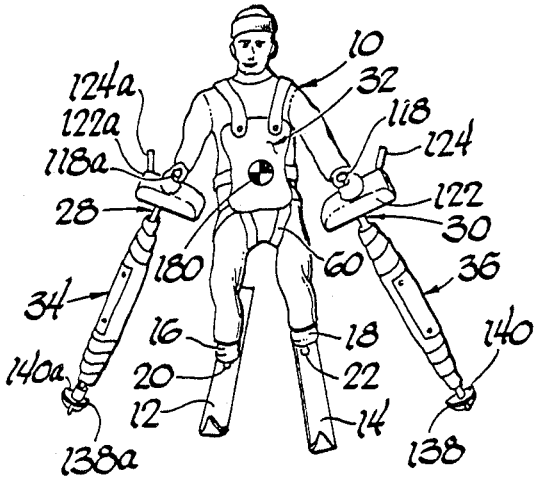
FIG. 3, similar to FIG. 2, is a front elevational view of a skier equipped with additional apparatus employing teachings of the invention.

FIG. 3 illustrates the same skier 10, as in FIG. 2, but now provided with ski wing panels 34 and 36, employing teachings of the invention, which are respectively wrapped in a stored condition about ski pole assemblies 28 and 30. The ski wing panels 34 and 36 are very light in weight and, in their wrapped condition, are not bulky thereby, as depicted in FIG. 3, permitting normal use of the ski pole assemblies 28 and 30 by the skier 10. A special feature of thusly having the wing panels 34 and 36 stored on the ski poles 28 and 30 is that it provides for ease of transportation especially when the skier is using uphill transportation as, for example, ski lifts, gondolas, cable cars, helicopters and the like.

Figure 4:
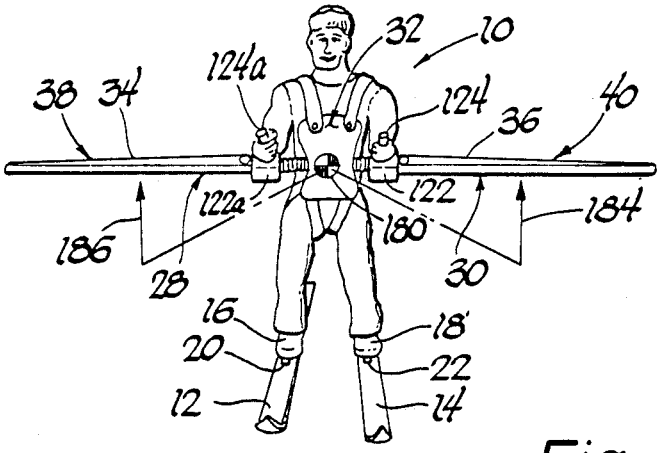
FIG. 4 is a front elevational view of a skier with the apparatus depicted in FIG. 3 being assembled and the skier now being ready for use of such assembled apparatus as for a downhill ski run.

FIG. 4 illustrates the same skier 10, as in FIG. 3, but now with the elements of FIG. 3 being assembled, converted into right and left skiing wing assemblies 38 and 40 which are, in turn, operatively connected to the skier's body as through the harness means 32.

Referring in greater detail to FIGS. 5, 6, 7, 8 and 9 the harness assembly 32 is illustrated as comprising a rigid main body or plate 42 which at its lower end is provided with right and left attachment posts 44 and 46 and, similarly, at its upper end is provided with right and left attachment posts 48 and 50 with each of such attachment posts being fixedly secured to the plate 42. Further, right and left hook-like members or anchors 52 and 54 are fixedly secured to the plate 42 as to be situated on the forward face or surface 56 of plate or body 42.

Figure 5:
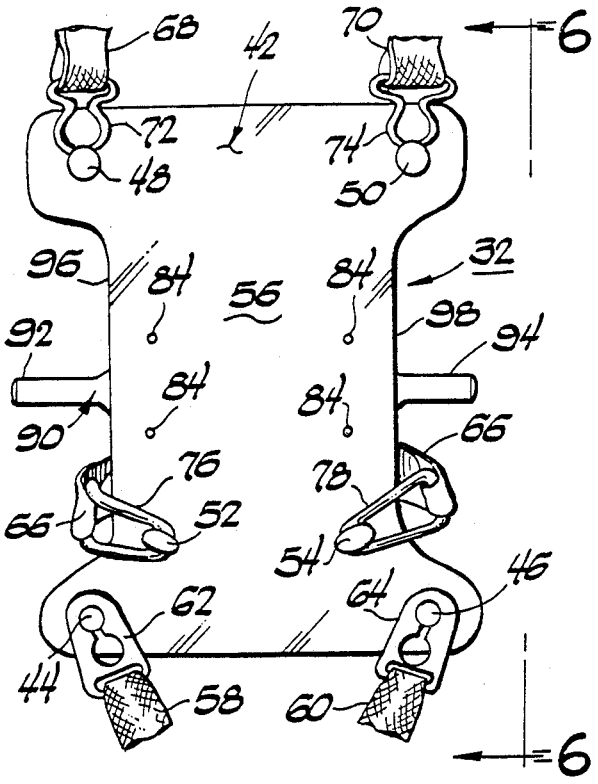
FIG. 5 is a front elevational view of the harness plate of FIGS. 2, 3 and 4 with fragmentarily illustrated associated harness straps.

A pair of underslung harness belts 58 and 60 are respectively provided with slotted buckle plates 62 and 64 which, as depicted, are respectively operatively detachably secured to anchor posts 44 and 46. As will become apparent, such belts 58 and 60 are intended to be passed as between the skier's legs or wrapped about the skier's legs, depending primarily on the skier's choice, with the respective opposite ends of such belts 58 and 60 then being suitably secured as to a generally transversely positioned harness belt 66 serving to generally encircle the skier's waist. A pair of shoulder or suspender type harness belts or straps 68 and 70 are respectively provided at their first ends with buckle means 72 and 74 which, in turn, are effective for latching engagement with anchoring or securing posts 48 and 50. The main or girding harness belt or strap 66 is preferably provided at its opposite ends with latching members or buckles 76 and 78 which, as generally depicted in FIGS. 5 and 8, respectively latchingly engage retainer posts 52 and 54.

The rear or inner surface 80 of the breast plate 42 has a bracket means 82 secured thereto as by, for example, a plurality of screws or rivets 84. The mounting bracket 82, which may be of suitable metal, is of a general channel configuration, in cross-section, and provided with laterally extending flanges 86 and 88 through which the shanks of the screws or rivets 84 extend.

A torsion bar 90, comprising torsion means, has a relatively enlarged generally medially situated main body portion which is closely received within the bracket 82 as to have its relatively narrower oppositely disposed ends 92 and 94 extending from the bracket and somewhat beyond the relieved or cut-out side portions 96 and 98 of the mounting or breast plate 42. The torsion bar 90, depicted as being of generally flat stock material with such flatness continuing through the ends 92 and 94, may be secured to the mounting bracket 82 by any suitable means as, for example, screws 100. The bracket 82 is preferably of such a dimension as to result in a spacing of at least 3.83 cm., as depicted at 102 of FIG. 6, between the inner channel surface 104 of bracket 82 and surface 80 of plate member 42.

Figure 8:
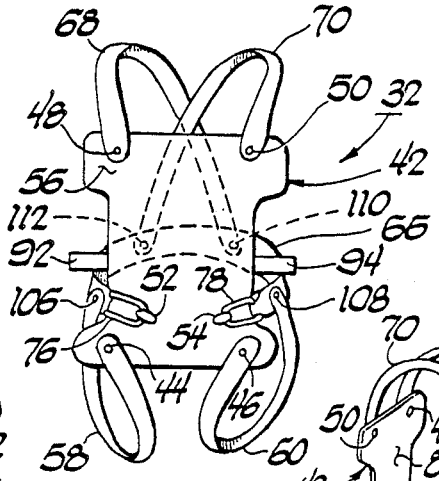
FIG. 8 is a front elevational view of a complete harness assembly employing teachings of the invention.
Figure 9:
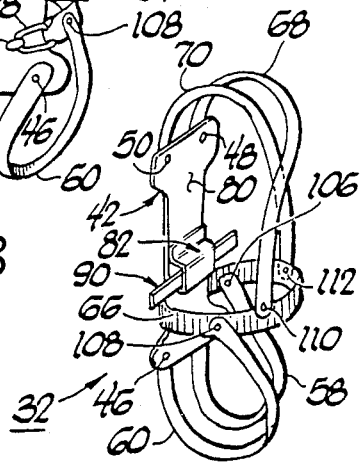
FIG. 9 is generally a perspective view of the harness assembly of FIG. 8.

As generally simplistically depicted in both FIGS. 8 and 9 the yet not described opposite ends of belts or straps 58, 60, 68 and 70 are each operatively secured to the waist or girding belt 66 as at 106, 108, 110 and 112. It is to be understood that such points or areas of attachment as at 106, 108, 110 and 112 may be either of a permanent or detachable type and, further, that any or all of the straps or belts 58, 60, 66, 68 and 70 may include suitable length adjustment means many of which are well known in the art even though for sake of clarity are not specifically disclosed.

Referring primarily to FIGS. 8 and 9, when the skier applies the harness assembly to the skier's torso, the skier may first place the breast or mounting plate against the skier's chest, as to locate the torsion bar bracket 82 somewhat below the skier's rib cage, at which time the main girding belt 66, passed about the skier's waist, is secured at its ends to anchors or posts 52 and 54, respectively. Next, the shoulder belts 68 and 70, first crossed along the skier's back, are looped over the skier's shoulders and respectively secured to anchor or latching posts 48 and 50. Straps or belts 58 and 60 are then passed generally behind and between the skier's legs and brought forwardly and upwardly and respectively secured to latching or anchor posts 44 and 46. Any and all of such straps may, of course, be adjusted for length as to firmly secure the harness assembly to the skier.

Referring in greater detail to FIGS. 10–18, in the preferred embodiment of the invention, the skier is provided with left and right hand ski pole assemblies 30 and 28 with the left hand ski pole assembly 30 being depicted in FIGS. 10, 11, 12, 17 and 18 while the right hand ski pole assembly 28 is depicted in FIGS. 15 and 16.

Referring primarily to FIGS. 10, 11 and 12, the left ski pole assembly 30 is depicted as comprising a ski pole 116 having at its generally upper end a skier's hand grip 118 and, at its lower end, a tip portion 120 which is employable by planting it into the snow as to perform various skiing maneuvers as is well known in the sport of skiing.

A cross-member or body 122 is secured to the ski pole 116 with the hand grip 118 preferably at a location axially immediately adjacent to the member 122. The member 122 may be formed of any suitable material and may be of solid or hollow construction. A secondary left hand grip means 124 is provided on body means 122 at a location which may be considered generally forwardly thereof and somewhat inclined as to have the free end of gripping means 124 generally forwardly disposed. Further, the cross-member 122 is provided with a pair of retainer means 126 and 128 which, to some limited degree, may be somewhat resiliently deflectable. As best seen in FIG. 11, each of such retainer means may be of a hook-like configuration as generally depicted at 128.

Somewhat near the cross-member 122, the ski pole 116 is provided with a locking or latching means 130, suitably secured thereto against relative movement, having an axially extending opening 132 which may be resiliently openable to a greater opening for purposes to be described.

The ski pole 116 is provided with a second locking or retainer means 134, suitably secured thereto against relative movement, as near the lower end of pole 116. As best seen in FIG. 11, the retainer means 134 is provided with a generally axially extending finger-like portion 136 which my be generally axially aligned with the slot-like opening 132 of retainer means 130.

A sturdy basket means 138 is also suitably fixedly secured to the ski pole 116 near its lower end and preferably outwardly of the lower retainer means 134. Referring to both FIGS. 10 and 11, it can be seen that the basket means 138 is of a generally L-shaped configuration (as viewed in FIG. 11) having a first body portion 140 generally transverse to the pole 116 and a second body portion 142 depending downwardly therefrom generally parallel to and spaced from the axis of pole 116. As viewed in FIG. 10, body portion 142 is formed as to have its free edge preferably of an accurate configuration. Similarly, as possibly best seen in FIGS. 2 and 3, transverse body portion 140 is also formed as to have its free edge preferably of an arcuate configuration. Preferably, the basket means 138 is formed of a suitable metal such as, for example, aluminum. As best seen in FIGS. 10 and 11, the body portion 142, retainer means 126 and 128, latching finger member 136 and slot-like opening 132 of latching means 130 are all located at the same side of the pole 116 and, further, the general plane of the free edge of body portion 142 is at least generally parallel to the functional axis determined by the upper retainer means 126 and 128.

As best seen in FIG. 12, the hand grip 118 is provided with an internal slot or opening 144 which has suitable flatted surface means as to thereby function as keying means the purpose of which is to be described.

The right-hand ski pole assembly 28 as depicted in, for example, FIGS. 15 and 16 may be considered the mirror image of left-hand ski pole assembly 30 and the elements of the right-hand ski pole assembly 28 which correspond to those elements heretofore specifically discussed, as with reference to FIGS. 10, 11 and 12, are identified with like reference numbers provided with a suffix "a".

Referring primarily to FIGS. 13 and 14, the left-hand wing panel 36 is depicted as comprising a suitable fabric portion 146 which at its aerodynamic inner end 148 is substantially wider than at its aerodynamic outer or wing tip end 150. The leading edge 152 of the wing panel fabric 146 may be aerodynamically swept back a relatively lesser amount while the trailing edge 154 may be aerodynamically swept forwardly a relatively greater amount. As generally depicted in FIG. 13 the peripheral portion of the wing fabric 146 may be provided with a suitable hem-like portion as generally depicted by stitching 156.

As generally depicted in FIG. 14, the upper end 148 of the wing fabric 146 is formed into a loop, having an inner opening or passage 158, as by suitable stitching 160. The fabric wing tip 150 is provided with retainer means 162 which, preferably, comprises a sturdy channel member of suitable material such as, for example, aluminum, having a first leg portion 164 and a second leg portion 166. The first leg portion 164 of the generally U-shaped channel-like member 162 may be secured to the wing fabric 146, as at its tip area, by any suitable means as, for example, a suitable bonding or adhesive among which is an epoxy cement. As depicted in FIG. 14, when the first leg portion 164 is fixedly secured to the fabric 146, a space exists as between the secured fabric portion and the second leg portion 166 of retainer 162. In the preferred embodiment, the length of the wing tip retainer means 162 is such as to extend over at least a major length or portion of the fabric wing tip 150.

Near the inner end of the wing panel 36, a plurality of openings 168 and 170 are preferably formed as through at least the upper portion of the fabric 146 forming the loop at 148 of the panel 36.

The loop opening or passage 158 is adapted to receive therein a preferably tubular cylindrical member 172, as depicted in FIG. 13, the axial length of which is preferably sufficient to permit the ends thereof to extend some distance beyond the leading and trailing edges, 152 and 154, of the wing panel fabric 146.

Referring now also to FIGS. 17 and 18, the left wing panel 36 is operationally secured to the left ski pole assembly 30 as by first inserting the depending body portion 142, of basket means 138, into the end retainer or channel member 162 as to be generally between the leg portions 164 and 166. The wing fabric 146 is then urged, and somewhat stretched or tensioned, toward the cross-member 122 while at the same time passing the inboard end 148 generally between the ski pole 116 and retainers 126 and 128. When the thusly tensioned wing fabric 146 is so positioned as to have cut-out portions or apertures 168 and 170 respectively in general registry with retainers 126 and 128, the tubular member 172 (along with the wing fabric 146 carried thereby) is urged toward such retainers 126 and 128 as to result in retainers 126 and 128 respectively passing through openings 168 and 170 and operatively engaging tubular member 172 in the depicted locked assembled configuration. At this time, of course, the depending end of basket body portion 142 is in abutting relationship with the bight portion of wing tip panel retainer means 162. As generally illustrated in FIG. 17, the left ski wing assembly 40 may be provided with suitable strap means 174 and 176 which may be detachably secured as by suitable snaps or the like to the wing tip retainer 162.

The right wing assembly 38 is comprised of a ski wing panel 34 which may be considered as a mirror image of the left ski wing panel 36 of FIGS. 13, 14, 17 and 18. All elements of the right wing assembly 38 (as appear in, for example, FIGS. 15, 16, 19, 20 and 21), which are like or similar to those hereinbefore specifically discussed with reference to FIGS. 13, 14, 17 and 18, are identified with like reference numbers provide with a suffix "a". Further, in constructing or assembling the right wing assembly 38, the procedure would be as that already described with reference to the left wing assembly 40.

Figure 19:
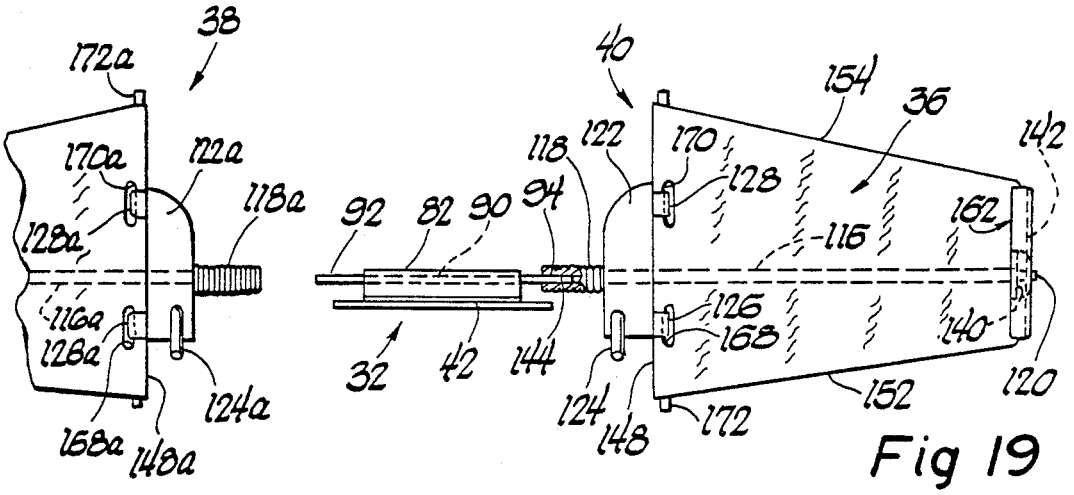
FIG. 19 is a top plan view of the left and right wing assemblies and a harness plate with the left wing assembly being partially operationally connected to the harness plate and the fragmentarily illustrated right wing assembly being detached, from the harness plate.
Figure 20:
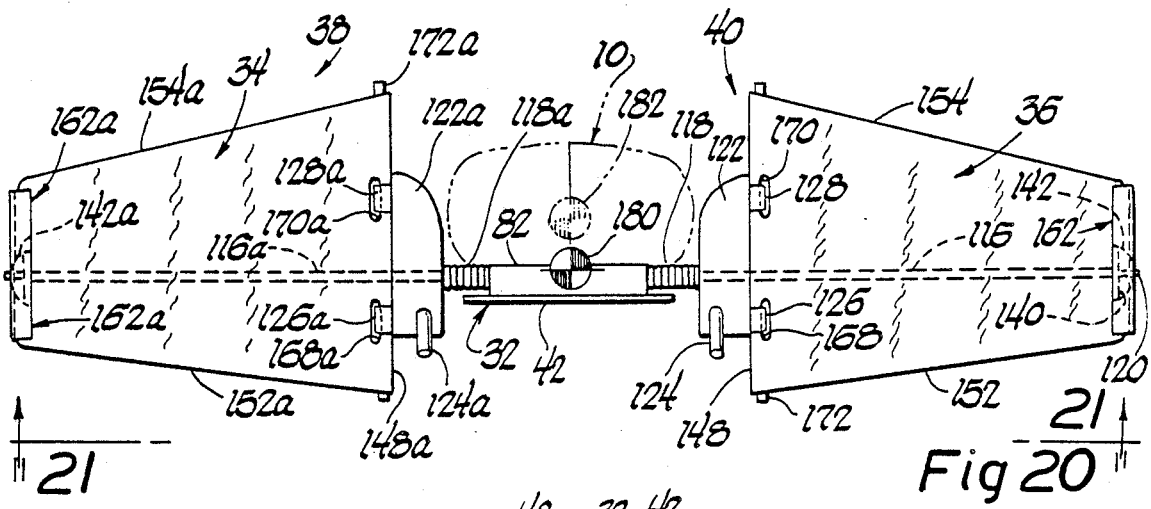
FIG. 20 is a top plan view of the wing assemblies and harness plate of FIG. 19 in an assembled condition.
Figure 21:
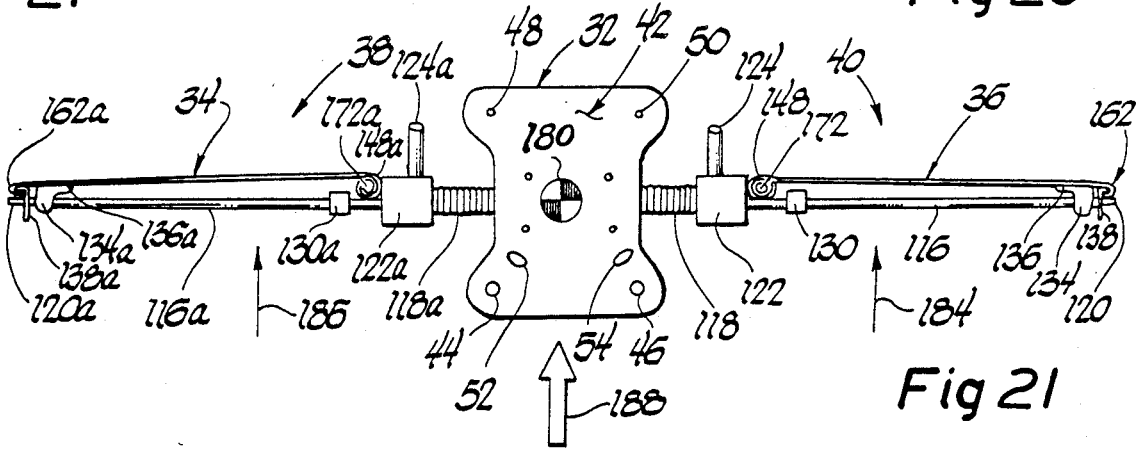
FIG. 21 is a view taken generally on the plane of line 21—21 of FIG. 20 and looking in the direction of the arrows.

Referring in greater detail to FIGS. 19, 20 and 21, once the left and right wing assemblies 40 and 38 are completed, they may be operatively connected to the harness means 32. More particularly, FIG. 19 depicts having the torsion bar extension portion 94 partly received in the cooperating slot or opening 144 of the hand grip 118. Upon further axial movement (axially of the ski pole shaft 116) of the wing assembly 40 toward the harness means 32, the torsion bar extension 94 will be operatively fully received in cooperating slot 144 and the wing assembly 40 will assume a relative position as generally depicted in FIG. 20. FIG. 19 also fragmentarily illustrates the right wing assembly 38 which is approaching operative engagement with the opposite torsion bar extension 92. When the wing assembly 38 is operatively engaged with the harness means 32, by having the torsion bar extension 92 operatively fully received in cooperating slot 144*a*, the right wing assembly 38 will assume a relative position as generally depicted in FIG. 20.

As generally illustrated in FIG. 21, the aerodynamic force experienced by the left wing assembly 40, represented by arrow 184, and the aerodynamic force experienced by the right wing assembly 38, represented by arrow 186, are transmitted via torsion bar means 90 to the harness means 32 as to have a resultant aerodynamic lifting force, represented by arrow 188, passing as through the center of gravity 180 of the harness means 32. As somewhat simplistically illustrated in FIG. 20, the center of gravity (and center of lift action) 180 is closely spaced from the center of gravity 182 of the skier's body 10 as when the skier is in an upright stance.

As already hereinbefore indicated, the extensions 92 and 94 provide for operative connection between the harness assembly 32 and right and left wing assemblies 38 and 40, respectively. Further, in the preferred embodiment the slots or recesses 144 and 144*a* are so formed as to provide for a keying means function with torsion bar means 90 and more particularly with torsion bar extensions 94 and 92, respectively. By so doing the wing assemblies 38 and 40, once assembled to the harness means 32, assume substantially the same angular inclination (about the axes of pole shafts 116 and 116*a*) as with respect to, a common plane of reference as, for example, the breast plate 42. Further, as should be evident as from, for example, FIGS. 19, 20 and 21, the axis of left wing assembly 40, as determined by ski pole shaft 116, is in substantial co-linear alignment with the axis of right wing assembly 38, as determined by ski pole shaft 116*a*. Similarly, such axes are preferably in co-linear alignment with the axes of keying slots 144 and 144*a* as well as with torsion bar extensions 92 and 94.

Operation of the Invention

FIG. 4 depicts the skier 10 with the harness means 32 and wing assemblies 38 and 40 operatively connected thereto with such connections being made as described with reference to FIGS. 19, 20 and 21. As generally illustrated, the skier's right forearm is in general juxtaposition to the cross-member 122*a* and the skier's right hand is grasping the auxiliary right control means or handle 124*a*. Similarly, the skier's left forearm is in general juxtaposition to the cross-member 122 and the skier's left hand is grasping the auxiliary left control means or handle 124.

As generally depicted in FIGS. 4 and 22, the wing assemblies 38 and 40, when attached to the harness means 32 and with the skier standing upright on a level horizontal surface or plane, may be so positioned in a normal or null position as to have their respective leading and trailing edges in a zero-degree angle of attack which, as is well known, is that angle which the chord of the wing airfoil assumes with respect to the apparent wind. However, as a further assistance and benefit to the skier, in the preferred embodiment of the invention the torsion bar means 90, and in particular torsion bar extensions 92 and 94, along with the keying slots 144 and 144*a* are so positioned, relative to the chord of the airfoils of wing assemblies 38 and 40 as to result in a normal, null or home position of the wing assemblies 38 and 40 providing some preselected positive angle of attack such as, for example, in the order of 6° as depicted in FIGS. 22, 23 and 24 and as indicated at 190 and 192 of FIGS. 23 and 24. Arrows 194 and 196 respectively diagrammatically depict the aerodynamic lift and drag created with the skier 10 making a downhill run with the wing assemblies 38 and 40 being at a positive angle of attack as, for example, a preselected magnitude of 6° .

In employing the invention, the skier, as while making a downhill run, may rotate the left and right wing assemblies 40 and 30 (about their axes) independently of each other merely by either pulling back or pushing forward upon auxiliary control means or levers 124 and 124*a*. While doing so, the skier need not worry about how far the skier must move or rotate the wing assemblies in order to again return to the home or null position because by merely relieving the effort applied to the control levers or handles 124 and/or 124*a*, the torsion bar extensions 94 and 92 will resiliently torsionally rotate the wing assemblies 40 and 38 to their preselected null or home position.

As generally depicted in FIGS. 25, 26 and 27, the invention enables the skier to also provide for differing angles of attack for the opposite wing assemblies. For example, in FIG. 25 the skier 10 is shown as having pulled-back on the control means 124*a* as to result in the right wing assembly 38 assuming a condition wherein the angle of attack, as indicated at 198 of FIG. 26, is substantially greater than that depicted at 190 of FIG. 23. The heavy arrows in FIG. 26 depict the apparent wind creating the resultant aerodynamic lift 200 and drag 202. At the same time the skier 10 is shown having pushed forwardly the control means or lever 124 thereby causing a condition, in the left wing assembly 40, wherein the angle of attack, as indicated at 204 of FIG. 27, has become a negative angle of attack (creating no aerodynamic lift) resulting in high aerodynamic drag and no lift. The heavy arrows in FIG. 27 depict the apparent wind creating the resultant drag 206 and negative lift 208.

When the skier 10 selectively positions the wing assemblies as generally depicted in FIG. 25 the created drag (with no lift) of the left wing 40 acts as an aerodynamic brake and affects the radius of gyration of the skier thereby assisting the skier to go into a left turn motion or maneuver because the right wing assembly 38 still has a better or greater forward momentum than the left wing assembly 40 and such right wing assembly 38, at least momentarily, provides a greater up-lift to the skier. All of such forces along with the skier's skillful body shifts and movements combine to give the skier easier and better turning power than the skier could obtain from the assist obtained from merely ski pole planting in the usual technique employed by skiers with prior art equipment as depicted, for example, in FIG. 1.

A skier employing the invention manipulates the changing of the angles of attack of the wing assemblies mainly for the purposes of initiating turns or, at certain times, slowing the skier's speed. In order to thusly manipulate or variably position the wing angles of attack, the skier has to manually overcome the resilient resistance provided by the torsion bar means 90 which is operatively secured to and carried by the plate or body means 42 of the harness means 32. The resilient resistance provided by the torsion bar or spring means 90 and sensed by the skier results in the skier quickly learning the "feel" of how much the skier has either increased or decreased the angle of attack from the null or preset angle of attack. Further, the skier quickly learns that all the skier must do to return to a normal path, after completing a turn, is to relax the skier's arm muscles and let the resilient force of the spring means 90 return the wing assemblies to their even preset angle of attack position.

Figure 7:
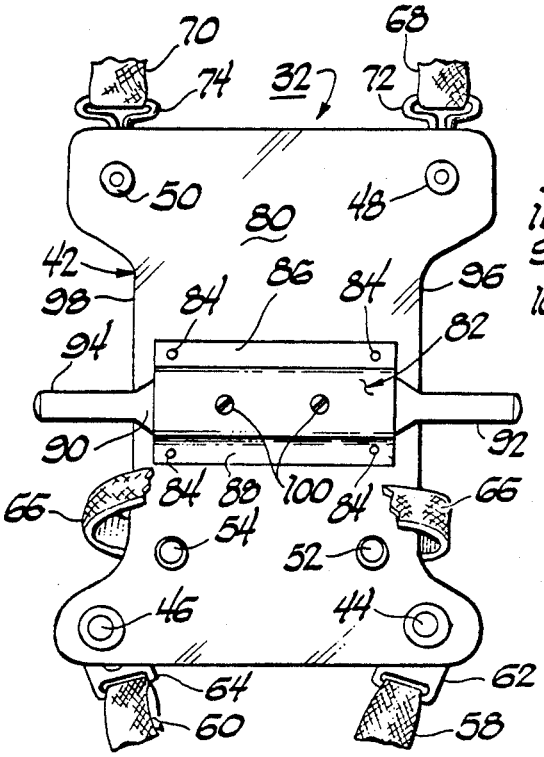
FIG. 7 is a view taken generally on the plane of line 7—7 of FIG. 6 and looking in the direction of the arrows.

As already indicated, as in FIGS. 5 and 7, the width of the harness breast plate or body 42 is reduced as at cut-out portions 96 and 98. This, in turn, enables the outer or top ends of the hand grips 118 and **118*a* to be brought further inwardly toward each other when the wing assemblies 40 and 38 are brought into full operating engagement with torsion bar means 90 thereby increasing the axial length of engagement as between torsion spring extensions 92 and 94 and the cooperating slots 144*a* and 144 of grips 118*a* and 118. Further, with such an arrangement it is possible to have the torsion bar extensions 92 and 94 not extending, transversely of the skier's body, a distance which would hinder the free movement of the skier's arms when wearing the harness means but not having the wing assemblies 38 and 40 operatively connected to such harness means 32**.

As previously stated, the harness means 32 when worn by the skier preferably locates the torsion bar or spring means 90 immediately below the skier's rib cage as to be generally pressed against the skier's abdomen thereby tending to bring the center of gravity 180 (and center of action) of the harness assembly 32 and wings 38 and 40 into coincidence with the center of gravity 182 of the skier's body. With the foregoing in mind, it becomes apparent that during use the lift and drag forces created by the left and right wing assemblies are transmitted via the cooperating torsion bar means 90 toward the center of action or gravity 180 of the harness means 32 and, in turn, re-applied or directed toward the skier's body center of gravity 182 which may be somewhat higher but still in close proximity to the center of gravity 180 of harness means 32.

Figure 28:
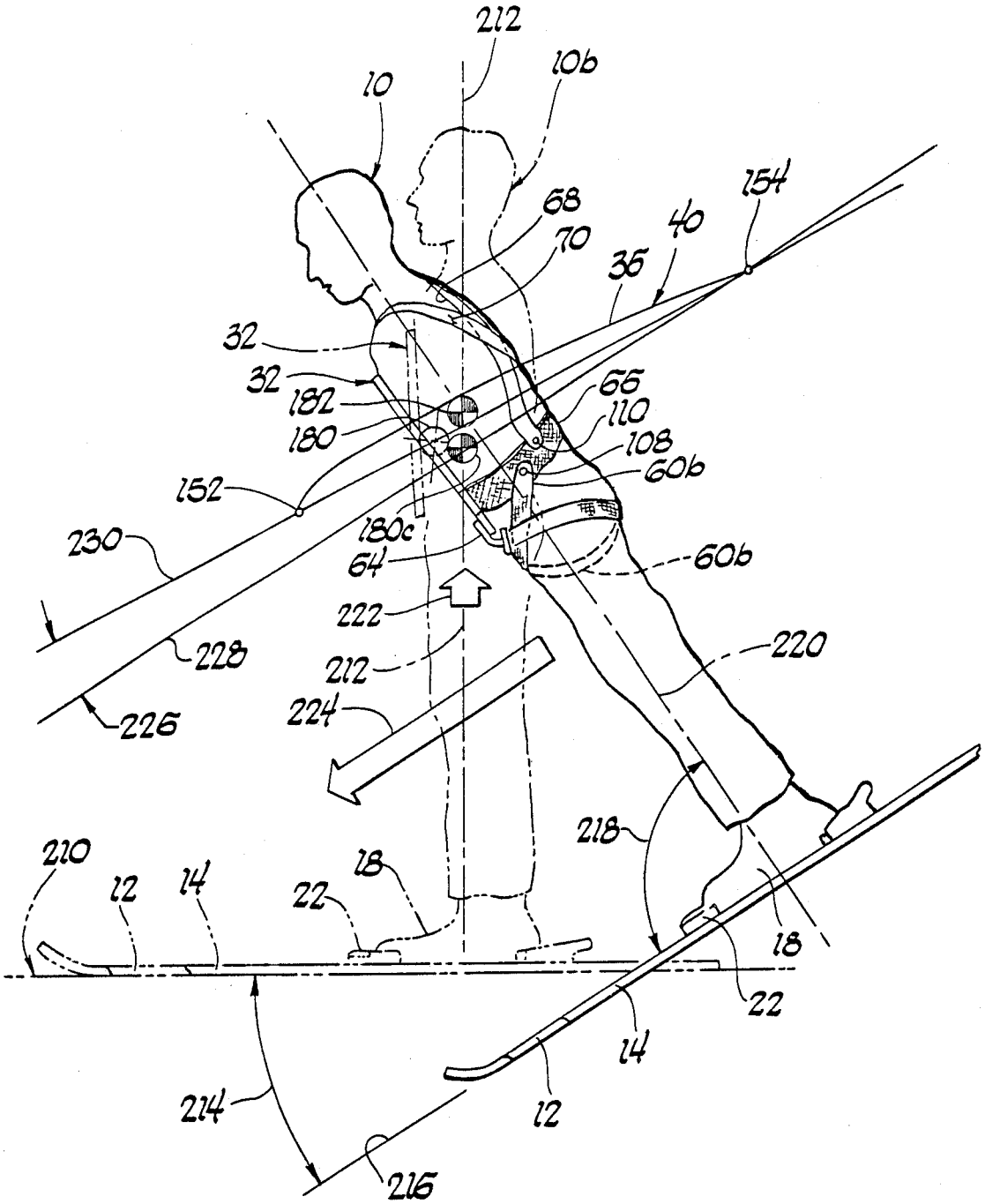
FIG. 28 is somewhat a schematic side view of a skier, positioned generally perpendicular to the slope of a downhill ski run, having selectively positioned the wing assemblies as to obtain an aerodynamic lift force.

To better understand the respective centers of gravity and their interrelationships reference is now made to FIG. 28 which schematically illustrates, in phantom line at **10*b*, the skier standing on flat terrain and not in motion and, in solid line at 10**, the skier on a downhill run and in motion.

Referring to FIG. 28, when standing still on a flat terrain and with the skier's skis 12 and 14 in or on a horizontal plane 210, the vertical axis 212 of the skier shows that the skier's basic center of gravity 182 is above the skier's hips whereas the center of gravity 180 of the harness means 32 and attached wings 38 and 40 is somewhat lower and more forwardly disposed as to be slightly above the skier's hips and waist belt height. The next considered condition or position is that of skier 10 depicted as in motion downhill on a slope of, for example, 30° as indicated at 214.

When the skier 10 moves down such a slope the skier can assume a position of generally 90° , as indicated at 218, with respect to the fall line 216 of such slope. Therefore, the skier's major axis 220, corresponding to axis 212 of skier **10*b*, still passes through the skier's body center of gravity 182. However, an interesting change of relative location of the center of gravity 180 occurs when the skier 10*b* is in a downhill motion. That is, because the center of gravity 180 (of the harness and wings) is somewhat lower and slightly forward of the skier's center of gravity 182 when the skier is in the position of 10*b*, such center of gravity 180 shifts, much as a pendulum to a new relative position, depicted at 180*c*, just below the skier's center of gravity 182 when the skier assumes a generally downhill position as generally depicted by 10. This general coincidence of centers of gravity (180*c* and 182) provided by the invention results in a significant advantage because, as it can be seen in FIG. 28, the sum of the generated lift forces, depicted by arrow 222 and generated during the skier's downhill run as depicted by arrow 224, substantially coincide with or pass through the skier's own weight reaction thereby resulting in the skier receiving a definite and positive sensation from the drag and lift forces created by the wing assemblies 38 and 40**.

Still considering FIG. 28, the lift effect on the skier 10 can be generally optimal if the wing assemblies are set as to have an angle of attack in the order of 6° , as indicated at 226, with reference line 228 being the direction of the apparent wind paralleling the slope 216 and reference line 230 being the extension of the wing air foil chord. As previously indicated, in the preferred embodiment of the invention the torsion bar means 90 and cooperating slots 144 and **144*a* are preferably preset as to provide such an initial preselected home, normal or null position resulting in a preselected minimal type of positive angle of attack of wing assemblies 38 and 40. Therefore, the skier is not required to manually regulate or position the wing assemblies 38 and 40 into a normal angle of attack. However, because the return spring means or torsion means 90 is resiliently deflectable in both rotary directions about the respective axes of wing assemblies 38 and 40, it is easily possible for the skier to override and change the normal preselected angle of attack of either or both the left and right wing assemblies 40 and 38** and, further, to do so independently with each wing assembly.

FIGS. 28, 8 and 9 should now be further considered with regard to a somewhat modified manner of securing the harness means 32 to the skier's body.

The harness assembly or means 32 of FIGS. 8 and 9 has been disclosed and described as having lower strap or belt means 58 and 60 which, as described and as illustrated in for example FIGS. 2, 3, 4, 22 and 25, are intended to pass simply between and behind the skier's legs and, when secured, to assume a configuration as generally depicted in FIGS. 8 and 9. In comparison, FIG. 28 illustrates a somewhat modified manner of securing the lower straps to the skier's legs. For ease of reference, in FIG. 28, the belt or strap means generally functionally equivalent to strap means 60 of FIGS. 8 and 9 is identified by reference number **60*b*. The other strap means, which would be identified as 58*b* and functionally equivalent to strap means 60*b*** but opposite thereto, is not shown.

As typically illustrated by strap or belt means **60*b* in FIG. 28, the belt 60*b* is suitably attached as at 108 to the girding belt 66 and then passed generally along and against the outside of the skier's left leg and generally forwardly thereof. The belt 60*b* is then passed along and against the forward portion of the skier's left leg from here the belt 60*b* continues somewhat downwardly and against the inside of the skier's left leg as generally depicted in hidden line. The belt 60*b* then continues behind the skier's left leg, generally somewhat below and against the left buttock, and then against the outer portion of the skier's left leg upwardly to where the end of the strap 60*b* is connected as via latch or clasp means 64 to anchor post 46 (both of which are more clearly shown in FIG. 5). The strap or belt means 58*b* (not shown) would be applied to and about the skier's right leg in a fashion which may be considered the mirror image of that described with reference to belt or strap means 60*b***.

One of the main benefits of strap means **58*b* (not shown) and 60*b* is that by effectively wrapping such about respective legs of the skier the overall harness means 32 is much more effectively secured to the skier's body minimizing any relative movement as between the harness assembly 32 and the skier's body. Just as with regard to belt means 58 and 60, so, too, the belt or strap means 58*b* (not shown) and 60*b* may be suitably permanently or detachably secured to the girding belt 66** (as well as selectively positioned therealong) and may be selectively adjustable for length.

Referring now in greater detail to FIGS. 13, 14, 15, 16, 17, 18 and 3, the invention also provides means whereby a skier after finishing a downhill run, while using the ski wing assemblies 38 and 40, is able to again either alone or by conventional transport go to the top of the ski run or slope. More particularly, the skier would first disconnect the left and right wing assemblies 40 and 38 from the torsion bar means 90 of harness means 32. Next, the skier would disassemble each of the wing assemblies in a manner generally opposite to the assembly of such wing assemblies as described with reference to FIGS. 17 and 18. At this time the skier, who could continue to wear the harness means 32, would have, disassembled from each other: (a) a left wing panel assembly 36; (b) a left ski pole assembly 30; (c) a right wing panel assembly 34 and (d) a right ski pole assembly 28.

Referring in particular to FIGS. 15 and 16, the skier would then take the right wing panel assembly 34 and insert latching finger **136*a* (operatively carried by the ski pole assembly 28) into one of the open ends of tubular member 172*a* and then press the opposite end of tubular member 172*a* into the resiliently openable slot 132*a* of upper disposed latching or retainer means 130*a* thereby effectively detachably securing the tubular member 172*a*, and corresponding end 148*a* of right wing panel assembly 34, to the ski pole shaft 116*a* of the right ski pole assembly 28. Once this is achieved, as generally depicted in FIG. 15, the wing panel assembly 34 is wound or coiled about the ski pole shaft 116*a* until completely wound thereabout as to result in a configuration as generally depicted in FIG. 16. The wound wing panel assembly 34 may be operatively secured in such a stored condition as by suitable strap means 174*a* and 176*a* which may be operatively secured to or detached from the wing panel assembly 34** and, further, may be of the type described as being of a teasel-and-fleece-like construction.

Similarly, the left wing panel assembly 36 would be stored onto the left ski pole assembly 30 in the manner as generally described with reference to the right wing panel assembly 34 and ski pole assembly 28.

As a consequence, the skier 10 would have left and right ski pole assemblies 28 and 30 with wing panel assemblies 34 and 36 respectively stored thereon as generally depicted in FIG. 3. With the wing panel assemblies thusly stored, the skier, still wearing the harness means 32 is clearly able to either on his own to again ascend the ski slope (as by conventional skiing techniques) or to be transported to the top of the ski run as by chair lift, gondola, etc. Further, even if the skier desires to spend some time skiing without using the ski wing assemblies (as In FIG. 4) the skier is able to do so with the sorted wing panel assemblies 34 and 36 since such do not significantly restrict the otherwise normal skiing techniques or movements. It is, of course, possible to totally remove the wing panel assemblies and ski conventionally with the ski pole assemblies as generally depicted in FIG. 2.

Even through possible, the primary intent of the invention is not to result in the skier becoming airborne but rather to convey a degree of aerodynamic lift to the skier as to have the skier feel lighter on the skis and have the sensation of flight.

The invention as herein disclosed and described provides a true sensation of flying on wings even if the skier never leaves the safety of solid ground (snow) contact. Therefore, generally, the wing area may be relatively small and relatively light in weight. Accordingly, such wing structures of the invention being relatively small lend themselves to being made collapsible and easily storable and, further, are quite inexpensive. Also, the wing structures of the invention do not require complicated and dangerous stabilizing controls nor do they cause aerodynamic stall conditions.

As already indicated, the invention provides an auxiliary wing-lifting structure of aerodynamic lift capacity sufficient to apply a lift force to the skier resulting in the skier having a sensation of flying, while moving downhill at various speeds, without the necessity of leaving the safe earth contact with the skis or becoming outright airborne. This has the advantage of giving to the skier the sensation of flight without having the skier submit to the great risks attendant airborne flight. Such airborne flight risks are believed to be the main reason why only a relatively few people engage in the sport of hang-gliding.

In an aspect of the invention, the invention provides a harness to efficiently transfer the generated aerodynamic lift forces in the direction of the basic center of gravity of the skier.

Further, in the preferred embodiment, the harness means is provided with oppositely extending torsion bar portions serving as operational connectors for the right and left wing assemblies; such torsion bar portions provide for resilient twisting characteristics relative to the harness means thereby enabling the skier to selectively and independently vary the respective aerodynamic angles of attack for the right and left ski wing assemblies operatively connected to the torsion bar portions.

The invention also provides for ski poles which are employable for forming a portion of the overall ski wing assemblies and when not so rigged are employable to function in the same manner a conventional prior art ski poles.

Further, the invention provides ski poles respectively provided with a sturdy cross piece or member, generally below the usual hand grip of the ski pole shaft, which serves as an arm rest for the skier when the ski poles are rigged to form respective right and left ski wing assemblies; a second hand grip also carried as by each of the cross piece members serves, by movement thereof, to selectively alter the aerodynamic angles of attack of the associated ski wing assembly.

In still another aspect of the invention, the cross piece or member carries tension holding and latching or retainer means whereby the associated wing panel assembly can be secured so that the air foil of the resulting ski wing assembly always functions adequately.

Also, in another aspect of the invention, once the respective ski wing panel assemblies are disconnected from the ski pole assemblies (that is, from its ski wing assembly configuration), the ski wing panel assembly can be stored on the ski pole as by wrapping the ski wing panel about the ski pole shaft, and suitably secured to maintain a stored condition, thereby enabling such ski poles with stored ski wing panel assemblies to be employed as conventional prior art ski poles.

Still further another aspect of the invention provides for a harness assembly having a frontal breast plate which is sufficiently sturdy to operationally carry a crosswise torsion bar mounted to such breast plate and wherein all necessary harness belting, webbing and attachment hardware are removably attachable to the breast plate.

Figure 6:
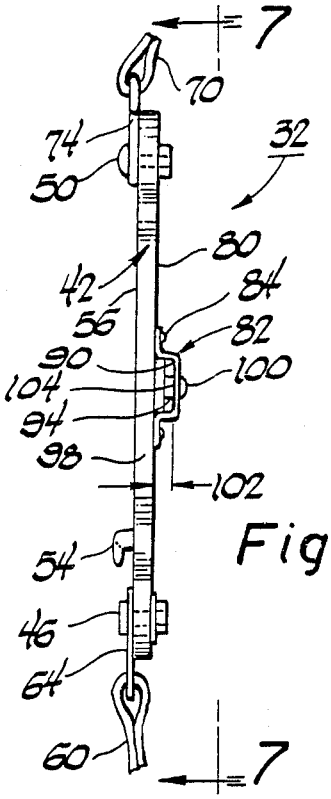
FIG. 6 is a view taken generally on the plane of line 6—6 of FIG. 5 and looking in the direction of the arrows.
Figure 29:
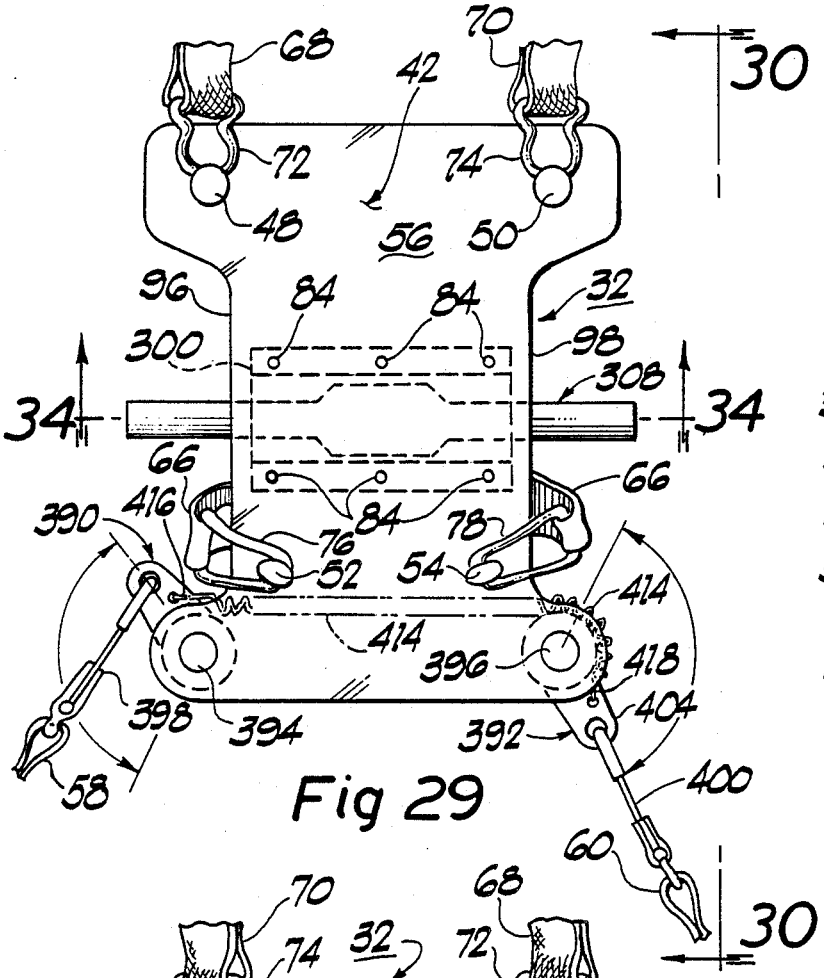
FIG. 29 is a view similar to that of FIG. 5 but illustrating certain modifications of the structure of FIG. 5.
Figure 30:
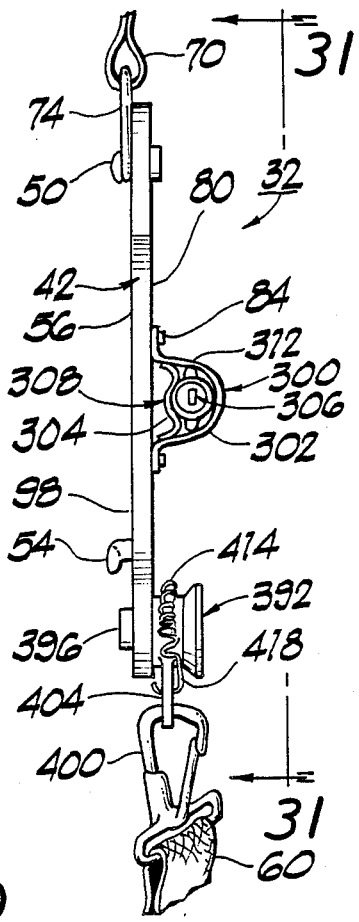
FIG. 30 is a view taken generally on the plane of line 30—30 of FIG. 29 and looking in the direction of the arrows.
Figure 31:
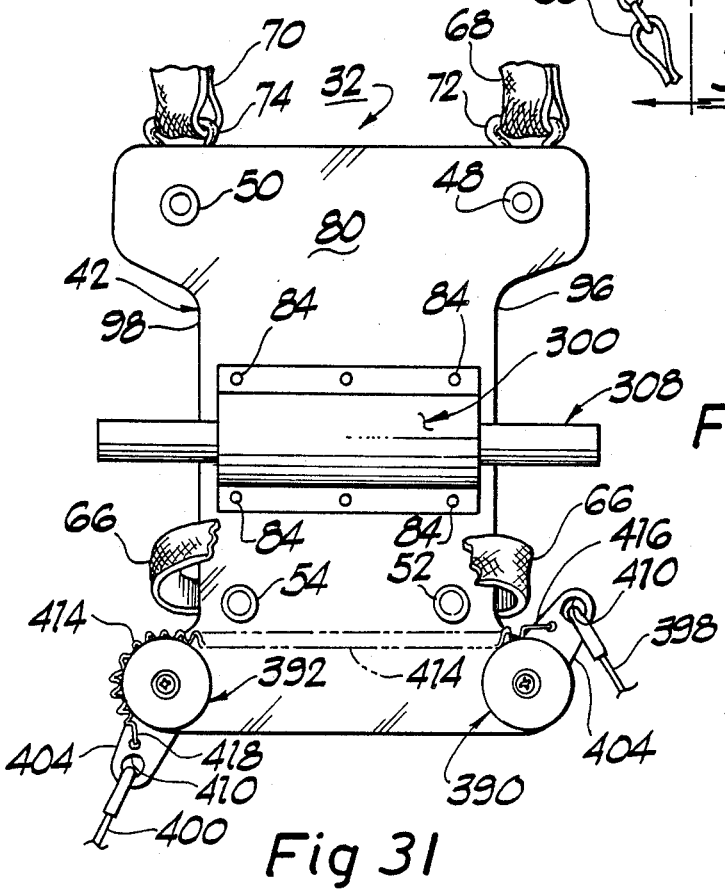
FIG. 31 is a view taken generally on the plane of line 31—31 of FIG. 30 and looking in the direction of the arrows.

FIGS. 29, 30, and 31 are views similar to FIGS. 5, 6 and 7 and illustrate modifications to the structure as depicted in FIGS. 5–9 as well as FIG. 28. All elements in FIGS. 29, 30 and 31 which are like or similar to those of FIGS. 5–9 are identified with like reference numbers and the specific description thereof is as described with reference to FIGS. 5–9 and/or FIG. 28.

As generally depicted in FIGS. 29, 30 and 31, the rear or inner surface 80 of the breast plate 42 has a mounting means 300 secured thereto as by, for example, a plurality of rivets or screws 84. The mounting means 300 is illustrated as comprising an outer housing-like member 302, which may be of suitable metal, and a cooperating inner containing member 304 which also may be of suitable metal. As will become apparent, members 302 and 304 cooperate to contain and secure torsion bar or spring means 306 and wing support means 308.

Figure 34:
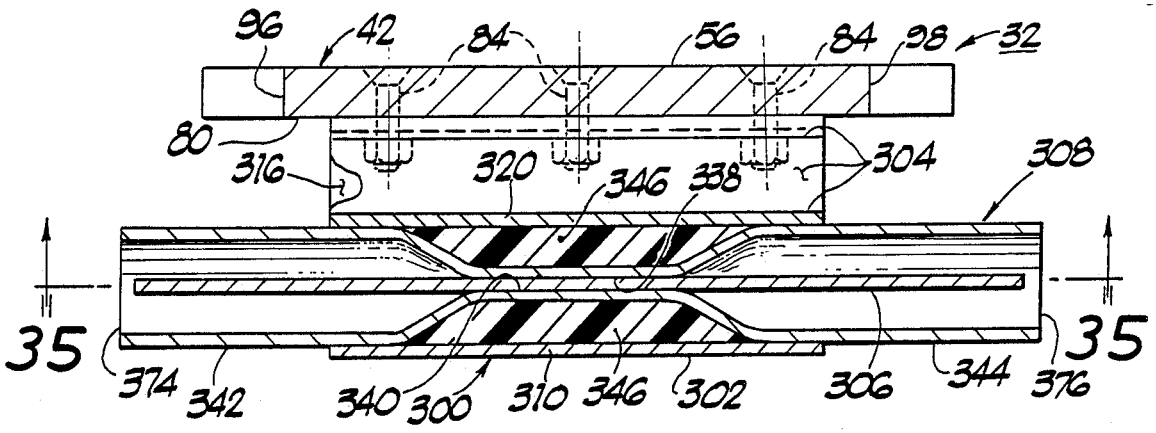
FIG. 34 is a relatively enlarged cross-sectional view taken generally on the plane of line 34—34 of FIG. 29 and looking in the direction of the arrows.
Figure 35:
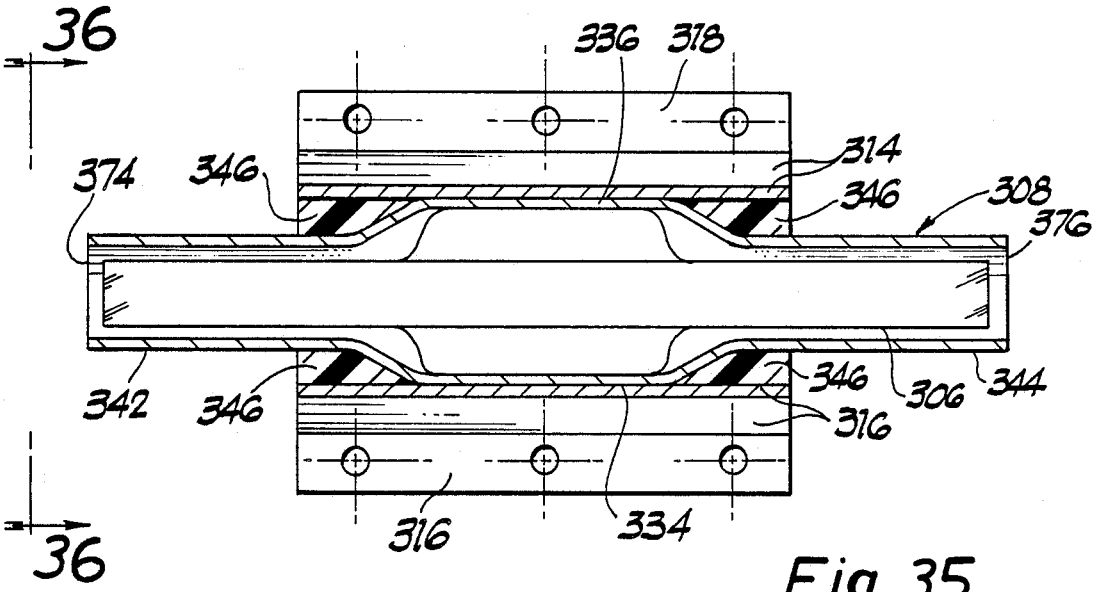
FIG. 35 is a cross-sectional view taken generally on the plane of line 35—35 of FIG. 34 and looking in the direction of the arrows.
Figure 36:
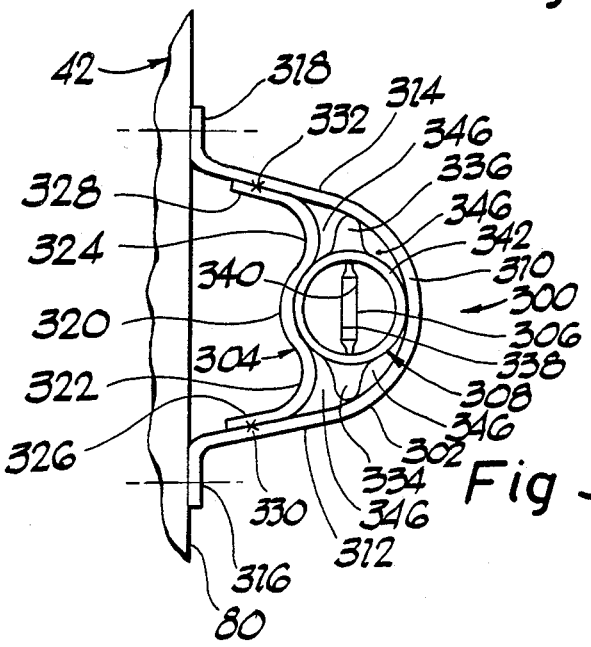
FIG. 36 is a view taken generally on the plane of line 36—36 of FIG. 35 and looking in the direction of the arrows.

Referring in greater detail to FIGS. 34, 35 and 36, it can be seen that the outer housing-like member 302 of the mounting means 300 may have a generally arcuate portion 310 (as viewed in FIG. 36) and side panel-like portions 312 and 314 extending therefrom and to the rear or inner surface 80 of the mounting plate 42 where outwardly extending flange portions 316 and 318 contact the mounting plate 42 and through which rivets or screws 84 serve to secure the mounting means 300 to the mounting plate 42.

As best seen in FIGS. 34 and 36, the inner containment member 304 is preferably of a length equal to that of member 302 and is formed into a wave-like configuration (as viewed in FIG. 36) whereby a generally medially situated and extending undulation or indentation 320 serves to engage one diametrical side of tubular member 308, as to urge it against the inner surface of arcuate portion 310, while oppositely situated and curved portions 322 and 324 serve to better stabilize the tubular member 308. Wall-like extensions 326 and 328, of the curved portions 322 and 324, may be secured to the struts or walls 312 and 314 as by welding as depicted at 330 and 332.

In the embodiment of FIGS. 34–36, a medial portion (axially medial) of the tubular member 308 is plastically deformed and flattened against opposite sides of the generally centrally situated torsion bar or spring means 306 thereby causing oppositely extending bulge-like or protuberant portions 334 and 336 while simultaneously containing and retaining the torsion bar both laterally and vertically as viewed in FIG. 36. While the generally medially situated portion is flattened, as at 338 and 340 against torsion spring means 306, the opposite end portions 342 and 344 remain cylindrical in configuration. In the preferred embodiment of the structure of FIGS. 34–36 a suitable reinforcing filler, such as epoxy 346, is provided in the space between members 302 and 34 and about tubular member 308.

Figure 37:
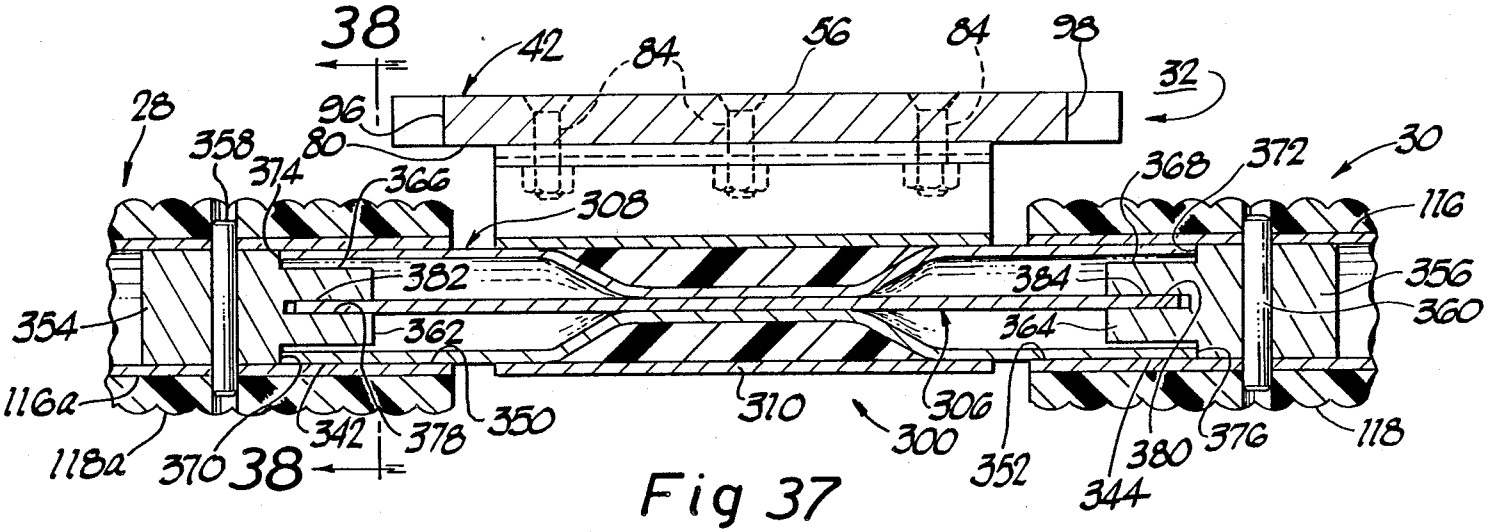
FIG. 37 is a view similar to that of FIG. 34 but illustrating fragmentary portions of modified ski pole assemblies operatively connected to the structure of FIG. 34.
Figure 39:
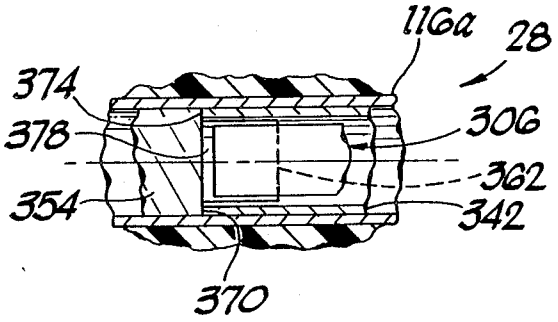
FIG. 39 is a cross-sectional view taken generally on the plane of line 39—39 of FIG. 38 and looking in the direction of the arrows.
Figure 38:
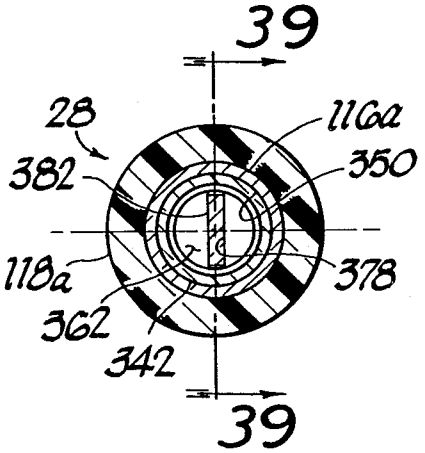
FIG. 38 is a cross-sectional view, in somewhat enlarged scale, taken generally on the plane of line 38—38 of FIG. 37 and looking in the direction of the arrows.

The purpose of the mounting or connecting means 300 is to be able to better tailor the spring rate of the torsion spring means 306 while providing the strength necessary to resist unwanted bending, as of the torsion spring, by forces generated by the upwardly directed lift forces of the wings. More particularly, it has been found that when the torsion bar means 90 of FIGS. 5, 6 and 7 is made sufficiently strong enough to itself withstand such unwanted bending, the torsion bar means 90 often results in having rather stiff torsion characteristics with the further result that some skiers find it somewhat uncomfortable in applying the force needed to torsionally rotate the wings to selected angles of attack. The mounting means 300 effectively solves this undesirable situation by providing means whereby the two duties thereof are separated. That is, the torsion bar means 306 (of FIGS. 29–36) may be selected for its desired spring rate while the strength and stiffness for preventing unwanted bending is provided by the tubular member 308. This will be better understood by reference to FIGS. 37, 38 and 39 in which the mounting means 300 is shown operatively connected to and carrying the fragmentarily illustrated pole means assemblies 28 and 30. The elements in FIGS. 37, 38 and 39 which are like or similar to FIGS. 10–27 are identified with like reference numbers. In FIGS. 37, 38 and 39, the left ski pole assembly 30 and right ski pole assembly 28 are shown modified as by having the respective ski poles **116*a* and 116** extending as through the respective grips 118*a* and 118 thereby presenting respective cylindrical open ends 350 and 352. The ski poles 116*a* and 116 are also depicted as respectively closely containing generally cylindrical members 354 and 356 therein and the grips 118*a*, 118, ski poles 116*a*, 116 and members 354, 356 may be operatively secured to each other, as to form an effectively rigid unitary structure, as by pins 358 and 360 or other functionally equivalent means.

The axially outer-most ends of members 354 and 356 are respectively formed into boss-like portions 362 and 364, which may have an outer cylindrical configuration, in which the outer surfaces 366 and 368 are of a transverse size and configuration permitting the reception thereabout of the cylindrical open ends 342 and 344 of the tubular support 308. The ends 342 and 344 of tubular support 308 are of an outer diametrical dimension as to closely, even snugly, be received within the inner cylindrical surface of the open-ended ski poles 116*a* and 116. Preferably, members 354 and 356 are provided with shoulder-like annular abutment surfaces 370 and 372 against which the extreme ends 374 and 376 of tubular support member 308 may abut.

Boss-like portions 362 and 364 are, in turn, provided with transversely and axially extending slots 378 and 380 which, in turn, respectively closely receive therein end portions 382 and 384 of the torsion spring means 306. In the preferred arrangement thereof, the very ends of end portions 382 and 384 do not engage the very inner end of slots 378 and 380 when ends 374 and 376 (of tubular member 308) abut against abutment surfaces 370 and 372.

In view of the foregoing, it should be apparent that with the modified form of the mounting means 300 and the modified form of the ski pole assemblies 28 and 30 of FIGS. 29–39, when the wing assemblies are operatively secured to the assembly 32, in a manner as generally described with reference to FIGS. 19, 20 and 21, the outer projecting cylindrical portions of tubular support member 308 will be operatively received in the open ends of the modified ski pole assemblies 28 and 30 (FIGS. 37, 38 and 39) and in so doing the opposite extending ends of the torsion spring means 306 will be received within the slots 378 and 380 of such modified ski pole assemblies. Consequently, the projecting tubular ends 342 and 344 of tubular support member 308 are sufficiently strong to withstand any undesired bending in such areas (otherwise caused by the lifting forces on the wing assemblies) and the strength or rigidity thereof is in no way transferred to the spring rate of the torsion spring means 306. That is, in such an arrangement the torsion spring means 306 is not required to physically support the wing assemblies but only to provide a spring rate for establishing a null position of the wing assemblies, as previously described, and provide a tailored spring rate against which the skier can comfortably work to select the skier's desired angle of attack of such wing assemblies as previously described with reference to FIGS. 22–28 such being done, of course, by a rotation of the ski poles 116*a* and 116 about tubular extensions 342 and 344, thereby having such coacting portions of poles 116*a* and 116 and tubular extensions 342 and 344 provide and function as journal means, while simultaneously torsionally twisting the projecting free ends of the torsion spring means 306, about its longitudinal axis, by the slots 378 and 380 which rotate with the modified ski pole assemblies 28 and 29 of FIGS. 37–39. It should also be pointed-out that because the wing support is provided by the tubular support member 308 and not the torsion string or bar 306, the torsion bar means 306 may, of course, be formed of a lighter and less stiff weight and/or configuration thereby resulting in a torsion bar or spring means 306 which is comparatively more resilient and responsive to the skier's desires and that the twisting or deflection of such torsion bar means 306 can be significantly increased without undue reactive forces placed upon the skier. The ultimate benefit of this is that the skier can easily, in comparison, increase both the positive and negative angles of attack of the wing assemblies, without experiencing objectionable reactive forces from the torsion bar means 306, even to the point of a negative angle of attack sufficient to slow the skier to a full stop if such be desired.

Figure 32:
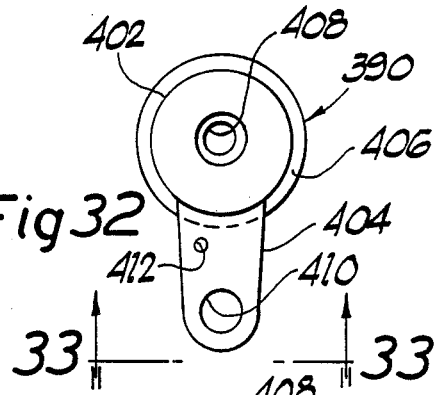
FIG. 32 is a relatively enlarged view of one of the elements shown in FIGS. 29, 30 and 31.
Figure 33:
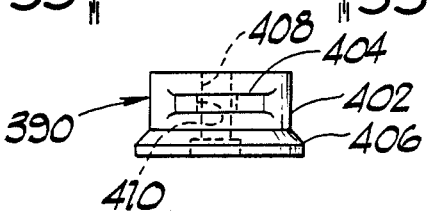
FIG. 33 is a view taken generally on the plane of line 33—33 of FIG. 32 and looking in the direction of the arrows.

FIGS. 29, 30 and 31, similar to FIGS. 5, 6 and 7, as well as FIGS. 32 and 33, illustrate further modifications to the structure as depicted in FIGS. 5, 6 and 7 as well as FIG. 28.

More particularly, belt means 58 and 60 were previously described as with reference to FIGS. 5, 6 and 7 (and FIGS. 8 and 9) as being adjustable in length but once being adjusted to the skier's needs such were effectively of fixed overall length. The same applied to belt means 58*a* and 60*a* of FIG. 28. The modification as illustrated in FIGS. 29–33 contemplates an arrangement whereby such belt or strap means 58 and 60 even though adjusted to the apparent needs of the skier still provide for controlled variations in the effective length thereof during the actual use of the apparatus. For example, with reference to FIGS. 5–9 (the same applying to FIG. 28), the belts or straps 58 and 60 may experience a degree of slack when the skier is in a low crouch or assumes the typical egg position. Because of such belt slack, the belts 58 and 60 may tend to slide a bit forward on the skier's thighs. Then, when the skier raises his skiing position the forwardly slid belts 58 and 60 may not fully slide back to their original positions thereby resulting in an uncomfortable sensation for the skier. (This, also applies to the differently looped pattern of belt means 58*a* and 60*a* of FIG. 28.) As will become apparent, the modification of FIGS. 29–33 enables such belt means 58 and 60 (as well as 58*a* and 60*a*) to be part of a stretch-retract system whereby the belt means 58 and 60 do not become slackened and, therefore, do not slide from their proper position on the skier's thighs.

The manner in which the modification of FIGS. 29–33 accomplishes this is by the use of a plurality of levers. More particularly, and referring primarily to FIGS. 29–33, a pair of lever means 390, 392 are pivotally secured to the breast plate 42 as by suitable stud-like pivots or posts 394 and 396. The ends of belts 58 and 60 (the ends being shown in FIGS. 29 and 30), instead of being detachably secured to fixed posts 44 and 46 as shown in FIGS. 5, 6 and 7, are detachably secured through cooperating shackle means 398 and 400 to lever means 390 and 392.

As typically illustrated by lever means 390 of FIGS. 32 and 33, each of such lever means may comprise a generally cylindrical main body 402 carrying a lever member 404 and a diametrically enlarged flange-like portion 406. A first clearance passage 408 formed through the main body 402 serves to pivotally accept the pivot member, as for example 394, while a second clearance passage or orifice 410 is formed through the lever member 404. The lever member 404 is preferably provided with a second orifice or aperture 412 formed therethrough. In the preferred embodiment of the modification of FIGS. 29–33, the length of straps or belts 58 and 60 may be adjusted (as generally described with reference to FIGS. 5–9) but the overall adjusted length thereof would be such as to be sufficient to attach the respective shackles 398 and 400 to lever holes 410 of respective lever means 390 and 392 when lever means 392 is rotated as to a position generally depicted in FIG. 29 and lever means 392 is rotated to a position which would be in effect a mirror image of the depicted position of lever means 390. Spring means 414, having ends 416 and 418, is provided as to resiliently urge lever means 390 in the clockwise direction (as viewed in FIG. 29) and as to resilient urge lever means 392 counterclockwise (as also viewed in FIG. 29). As generally depicted in FIG. 29 the spring means 414 extends generally transversely of plate 42 as to have one of its ends 416 operatively connected to lever means 390, as through its aperture 412, and another of its ends 418 operatively connected to lever means 392, as through its aperture 412. The spring means 414 continually urges lever means 390 and 392 as from a position depicted by lever means 393 of FIG. 29 to a position depicted by lever means 390 of FIG. 29.

Accordingly, it should now be apparent that after the skier has properly adjusted the lengths of belt means 58 and 60 and secured such to the lever means 390 and 392, which at that time would be in a generally downwardly depending condition, as typified by lever means 392 of FIG. 29, any subsequent skiing maneuver by the skier (which would otherwise exhibit a tendency to have the strap means 58 and 60 of FIGS. 5–9 and 28 to become slackened and thereby shift along the skier's thighs) permits the spring means to continually expand or contract, as the case may be, to thereby rotate lever means 390 and 392 and accordingly shorten or increase the effective length of such strap means. Consequently, such strap means 58 and 60 (as well as 58*a* and 60*a*) do not experience a slack, do not shift out of a desired position on the skier's thighs and the belts are maintained, in all situations, comfortably snug.

Figure 40:
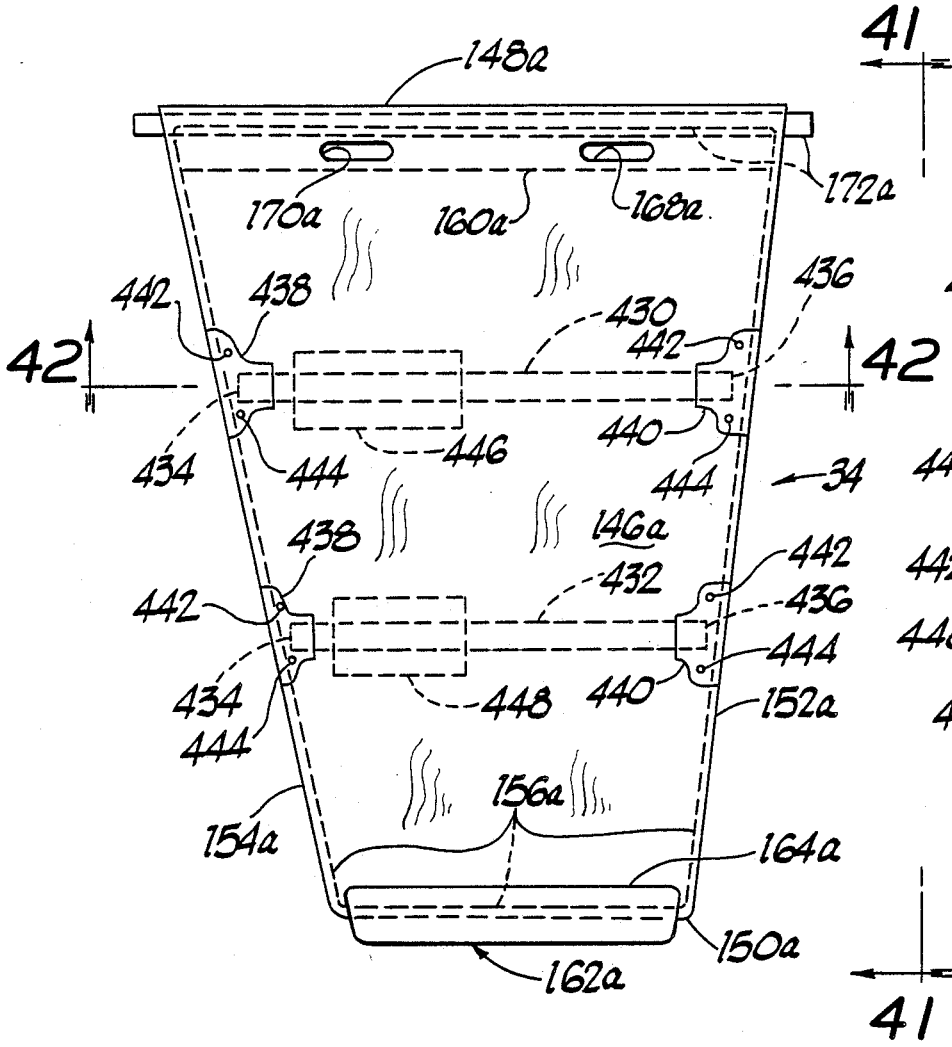
FIG. 40 is a view similar to the wing panel of FIG. 15, which is the mirror image of the wing panel of FIG. 13, but illustrating certain modifications of such structure.

FIG. 40, a view similar to the wing panel of FIG. 15 and a mirror image to the left wing panel of FIG. 13, illustrates a modification to such wing panels of FIGS. 15 and 13. All elements in FIGS. 40, 41 and 42 which are like or similar to those of FIG. 15 are identified with like reference numbers and the specific description thereof is as described with reference to, for example, FIG. 15.

Figure 41:
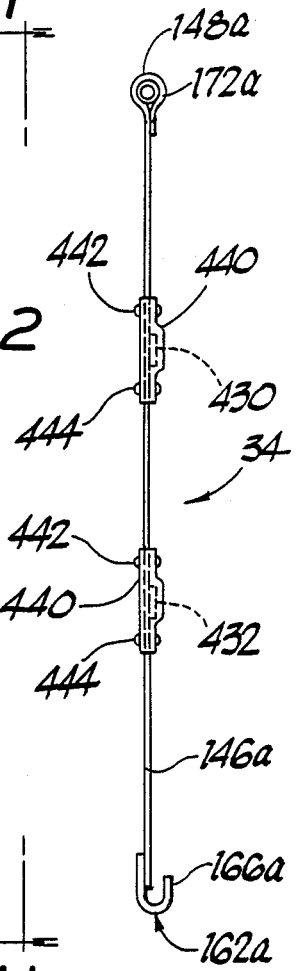
FIG. 41 is a view taken generally on the plane of line 41—41 of FIG. 40 and looking in the direction of the arrows.
Figure 42:
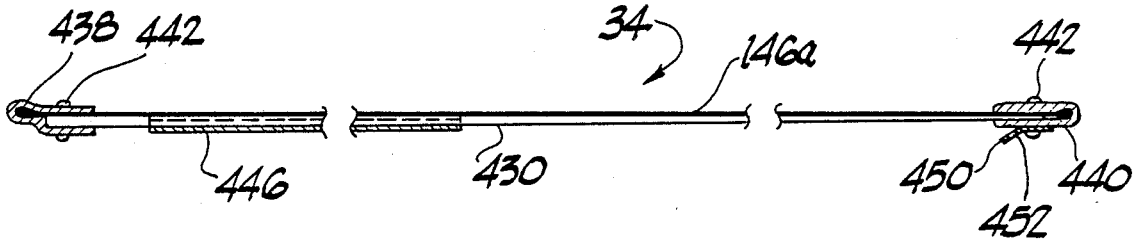
FIG. 42 is a relatively enlarged cross-sectional view, with portions thereof broken away, taken generally on the plane of line 42—42 of FIG. 40 and looking in the direction of the arrows.

Referring in greater detail to FIGS. 40, 41 and 42, the modification contemplated therein is the provision of means for forming an airfoil in the wing panel when such is assembled into its overall wing assembly. More particularly, the modification contemplates the provision of preferably at least two batten members 430 and 432 positioned generally transverse to the longitudinal axis of the wing panel material 146*a* and situated at and to the underside of the panel material 146*a*. In the preferred form of the modification, the battens 430 and 432, while in their free or normal state, are generally flat or straight as depicted in FIGS. 40, 41 and 42. Further, it is preferred that such battens 430 and 432, although flexible, be of a varying degree of flexibility generally over their respective lengths. In the embodiment disclosed, this is accomplished by having each of the battens 430 and 432 tapered in its thickness over its length as generally, and typically, illustrated by batten 430 in FIG. 42. As shown in FIG. 42, the batten 430 becomes thicker, and therefore stiffer and more resistant to bending, as it approaches the trailing edge 154*a* of the wing panel assembly 34; also the batten 430 becomes thinner, and therefore of greater flexibility, as it approaches the leading edge 152*a* of the wing panel assembly 34. (In FIG. 42, the batten 430 is not cross-hatched as to thereby enhance clarity thereof, while the wing panel material 146*a* is, instead of cross-hatched, merely illustrated as a heavy line immediately above the batten 430.) The battens may be formed of any suitable material as, for example, an epoxy fiberglass.

Again, as typically illustrated by batten 430 in FIG. 42, each of such battens 430 and 432 may be operatively secured at their opposite ends 434 and 436 to the wing panel material as by suitable retainers 438 and 440 which, in turn, may be suitably secured to the wing panel material 146*a* respectively at the trailing edge 154*a* and leading edge 152*a* thereof. The retainer means 438 and 440 may be of any suitable form as, for example, thin plastic or the like sewn, riveted or cemented to the wing panel material 146*a* or may be made of thin stock metal somewhat of a clasp-like configuration which is riveted, as at 442 and 444, to and through the wing panel material 146*a*.

Further, in the preferred form of the modification of FIGS. 40, 41 and 42, each of the battens 430 and 432 are suitably secured, for a substantial portion of their respective lengths, to the wing panel material 146*a*, at the underside thereof, and generally at the rearward portions thereof with such being as the battens approach the trailing edge 154*a* of the wing panel 34.

In the embodiment disclosed such is accomplished as by sections of sheet-like material generally wrapped under the related batten and then suitably secured to the underside of the wing panel material 146*a* as by, for example, cementing. One of such attachment or retainer sections of sheet-like material is depicted at 446, effectively securing batten 430 to the wing panel material 146*a*, while a second of such attachment or retainer sections of sheet-like material is depicted at 448, effectively securing batten 432 to the wing panel material 146*a*. If desired, the respective battens could be directly cemented to the underside of the wing panel material 146*a* as in the areas generally longitudinally spanned by the containing or retaining means 446 and 448.

Further, if desired, a tab-like member 450 may be provided, preferably in longitudinal alignment with each of the battens, at generally the leading edge 152*a* of the wing panel 34. Each of such tab members or attachment means 450, typically illustrated in FIG. 42, may be provided with a hole 452 formed therethrough.

Figure 43:
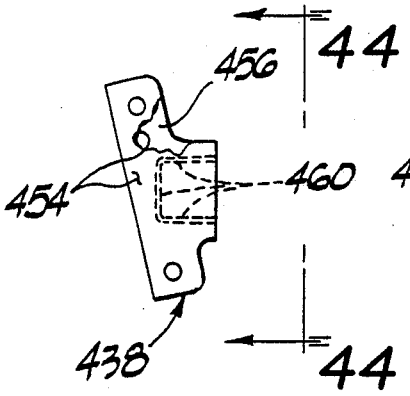
FIG. 43 is a relatively enlarged view of one of the elements shown in FIG. 40.
Figure 44:
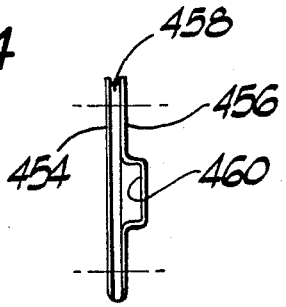
FIG. 44 is a view taken generally on the plane of line 44—44 of FIG. 43 and looking in the direction of the arrows.
Figure 45:
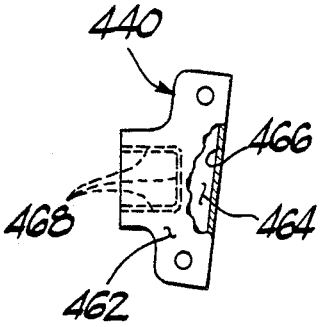
FIG. 45 is a relatively enlarged view of another element shown in FIG. 40.

FIGS. 43, 44 and 45 illustrate, in relatively enlarged scale, a possible configuration for each of the retainers 438 and 440 (of FIGS. 40–42). As depicted in FIGS. 43 and 44, the retainer 438 may be of a clasp-like configuration having a plate-like upper disposed body portion 454 and a generally lower disposed plate-like body portion 456 which are joined by a bight portion 458. When viewed as in FIG. 43, the outer edges of the upper and lower body portions 454 and 456 may have the same configuration. The lower plate-like body portion 456 is shown as having a pocket-like depression 460 formed therein as to receive the end 434 of the batten therein while the wing panel material 146*a* is received between the plate-like body portions 454 and 456.

Similarly, retainer 440 has respective upper and lower plate-like body portions 462 and 464, joined by a bight portion 466, which receive therebetween the wing panel material 146a while a pocket-like depression 468, in lower body portion 464, receives the end 436 of the related batten.

Figure 46:
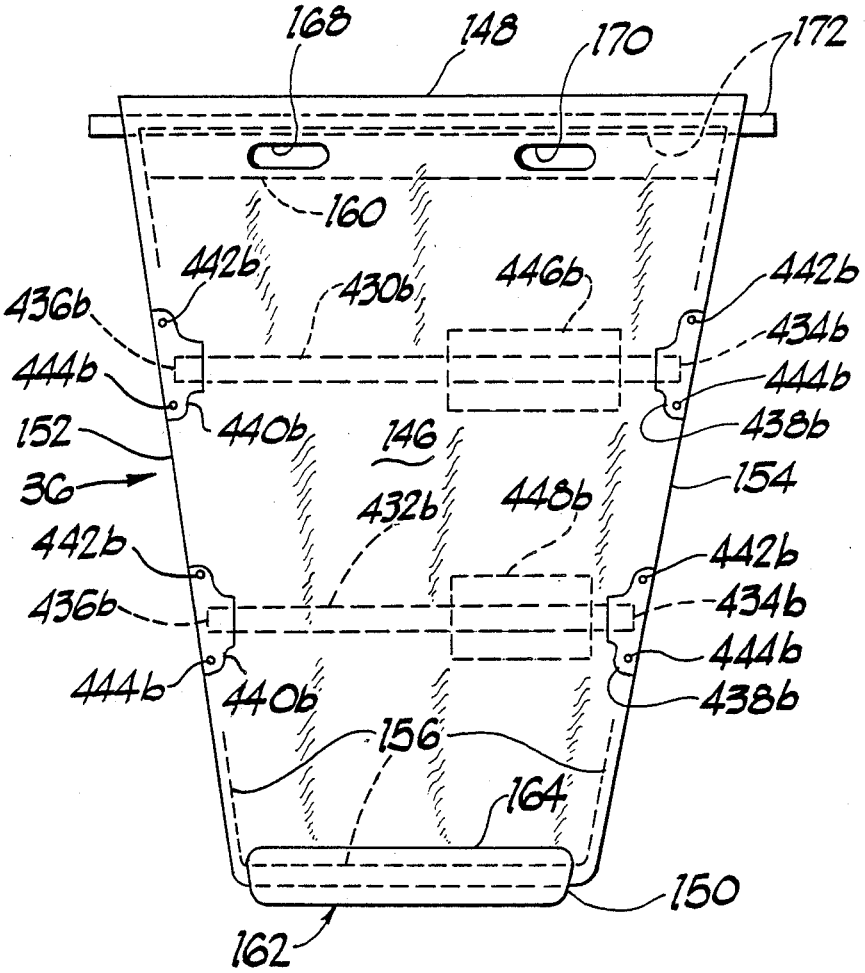
FIG. 46 is a view similar to that of FIG. 13 but illustrating certain modifications thereto.

FIG. 46, the left wing panel assembly, is a view similar to that of FIG. 13 but illustrating a modification thereof as to conform to the modifications herein disclosed with regard to the right wing panel assembly of FIGS. 40, 41 and 42. Those elements in FIG. 46 which are like or similar to those of FIG. 13 are identified with like reference numbers and the specific description thereof is as described with reference to, for example FIG. 13. Those elements in FIG. 46 which correspond directly to or are mirror images of the modifications in FIGS. 40, 41 and 42 are identified with like reference numbers provided with a suffix "b" and the description thereof, including tab or connector 450, is as described with reference to FIGS. 40–45.

Figure 49:
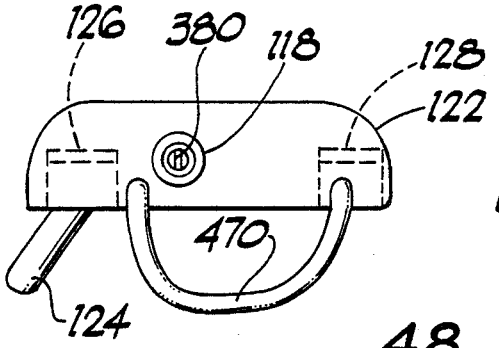
FIG. 49 is a view taken generally on the plane of line 49—49 of FIG. 47 and looking in the direction of the arrows.
Figure 47:
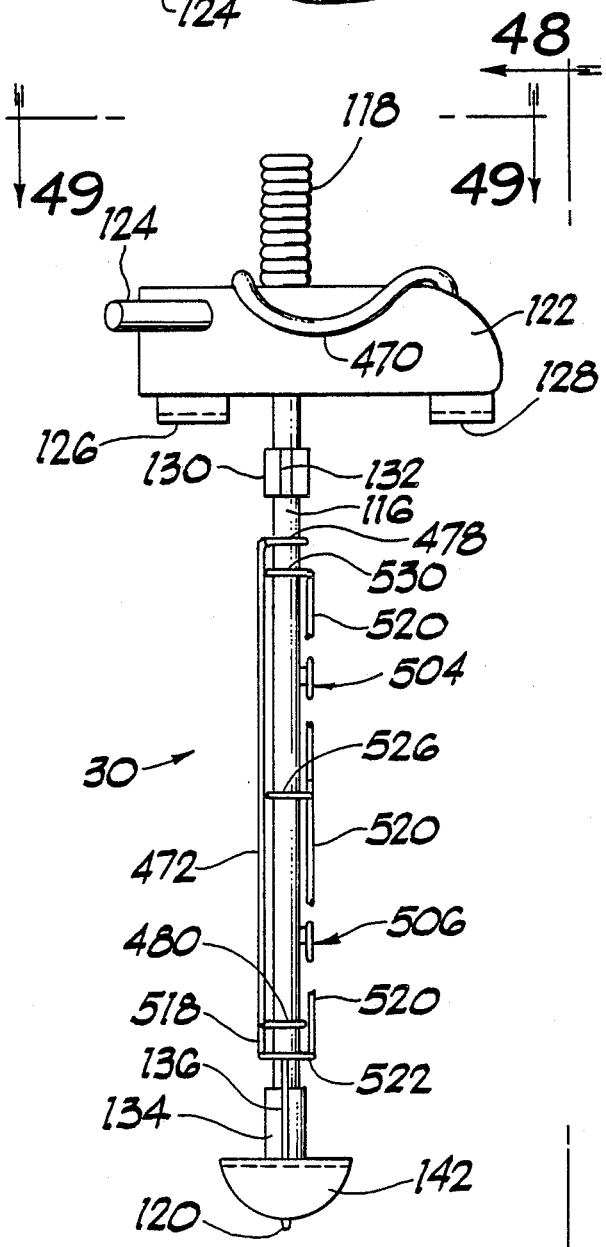
FIG. 47 is a view similar to that of FIG. 10 but illustrating certain modifications of the structure of FIG. 10.
Figure 48:
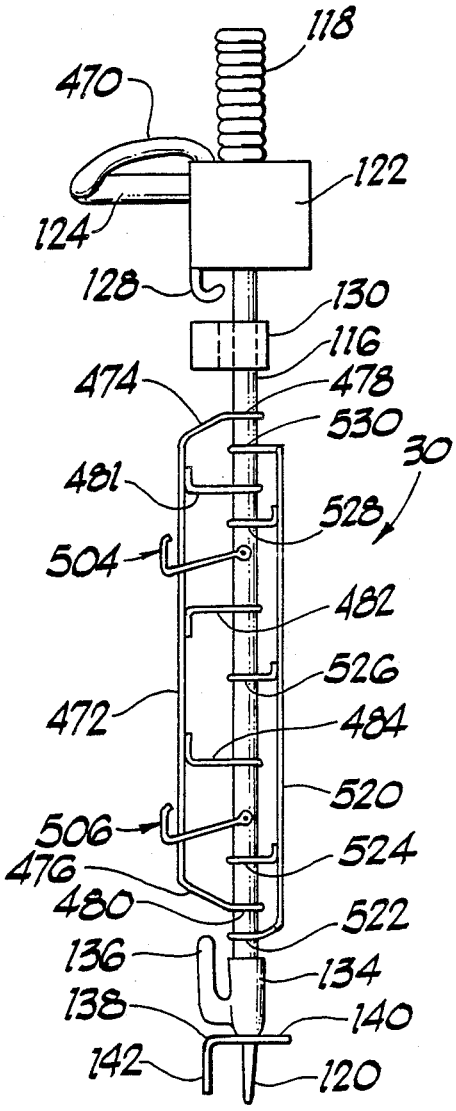
FIG. 48 is a view taken generally on the plane of line 48—48 of FIG. 47 and looking in the direction of the arrows.

FIGS. 47, 48 and 49, views respectively similar to FIGS. 10, 11 and 12 illustrate further modifications of the structure of FIGS. 10, 11 and 12. All elements in FIGS. 47, 48 and 49 which are like or similar to those of FIGS. 10, 11 and 12 are identified with like reference numbers and the specific description thereof is as described with reference to, for example, FIGS. 10–12. The upper end, as at 118, may, of course, include the modified configuration as depicted in FIG. 37 with the key-like slot 380 (as discussed with reference to FIGS. 37, 38 and 39).

Referring in greater detail to FIGS. 47–49, a first modification is contemplated by the provision of a substantially non-deflectable bar member 470 suitably secured at its opposite ends as to the cross-member 122. As best seen in FIGS. 47 and 48 the bar member 470 is preferably contoured as to enable the skier to place his left forearm onto the cross-member 122 and generally somewhat under and against the member 470 to thereby be able to generally continually urge the wing assembly toward the skier's torso thereby better positioning the skier's arms and incidentally urging the wing structure to always maintain full engagement with the harness and support structure means.

Figure 50:
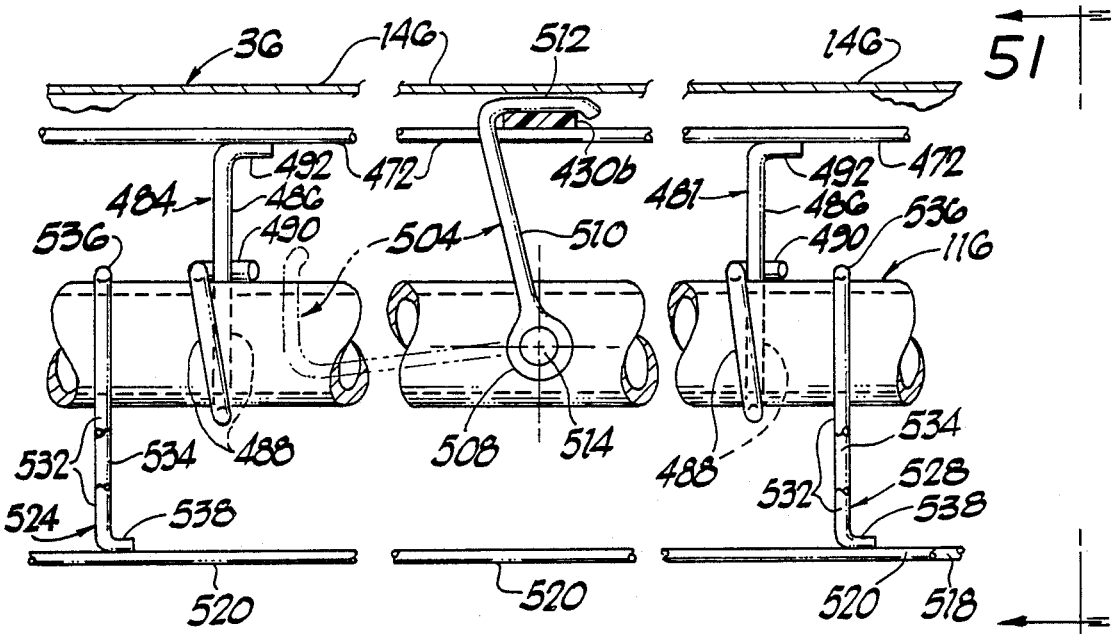
FIG. 50 is an enlarged fragmentary view of the structure of FIGS. 47 and 48 with the direction of view being taken as that of FIG. 48.
Figure 51:
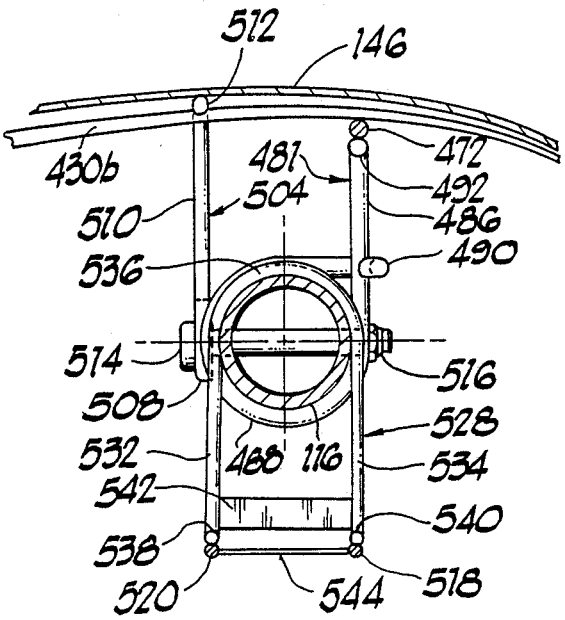
FIG. 51 is a view taken generally on the plane of line 51—51 of FIG. 50 and looking in the direction of the arrows.

FIGS. 47 and 48 illustrate a further contemplated modification with such comprising, preferably, a ridge-forming means 472 which may be parallel to the axis of the ski pole 116 and spaced therefrom. The ridge means 472 may be comprised of relatively small diameter rod material suitably bent at its opposite ends 474, 476 and fixedly secured by any suitable means as at 478 and 480 to the ski pole 116. In the preferred form of such modification, a plurality of stiffening or reinforcing means 481, 482 and 484 are suitably fixedly carried by the ski pole 116 and suitably secured to the spaced ridge means 472 as by, for example, welding. FIGS. 50 and 51, in relatively enlarged scale, illustrates that each of such reinforcing means 481, 482 and 484 may be comprised of wire or rod like material which has a first portion 486 projecting away from the ski pole 116 and a second portion 488 generally tightly wrapped about the ski pole 116 and hooked, as by an end portion 490, to the projecting portion 486. The outwardly displaced end 492 of the projecting portion 486 may be bent and abutted against ridge means 472 and welded thereto. It is contemplated that the supports 481, 482 and 484 may be mechanically fixedly secured to ski pole 116 as well in effect cemented thereto as by epoxy or the like.

The modified form of the right ski pole assembly is not illustrated; however, such modified form of the right ski pole assembly would be a mirror image of that shown in FIGS. 47–49 and comprise the modifications therein already described as well as those to be described.

Figure 52:
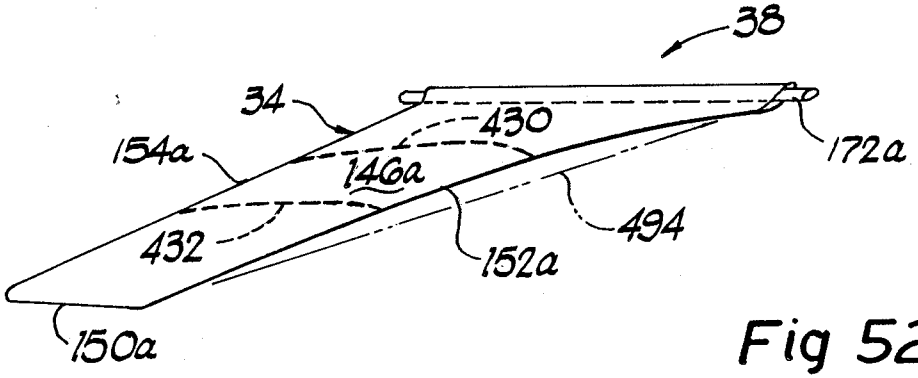
FIG. 52 is a perspective depiction of the configuration which the wing panel of FIG. 40 may assume when assembled into its overall wing structure.

FIG. 52, somewhat simplistically illustrates the airfoil configuration of the right wing panel assembly 34 of FIGS. 40–42 when assembled to its related right hand ski pole assembly modified as to include ridge forming means 472 (as described with reference to the left hand ski pole 30 of FIGS. 47 and 48). For purposes of clarity, such ski pole assembly is not illustrated in FIG. 52; however, the manner of securing the wing panel assembly to the related ski pole has already been discussed, as with reference to FIGS. 16 and 17, and such may be considered as having been done, but with the modified ridge-added ski pole, in FIG. 52. Consequently, the battens 430 and 432 will each engage and lie across the ridge means 472 of the modified right ski pole. Further, since outboard end 150a of the wing panel assembly 34 is secured against movement by portion 142a of the retainer or basket means 138a (of the said modified right ski pole) while the wing panel material 146a is effectively longitudinally stretched by virtue of pole member 172a being brought into engagement with hook-like members 126a and 128a (of the said modified right ski pole) both the leading edge 152a and the trailing edge 154a of the wing panel 34 are in tension and thereby tending to assume substantially straight lines from inboard to outboard ends of the resulting wing assembly 38. In so doing, the tension forces the leading (relatively more flexible) ends of the battens 430 and 432 to curve downwardly from the ridge means 472 thereby forming the generally depicted airfoil configuration of FIG. 52. The same would apply to the left wing panel assembly 46 when assembled onto the ski pole assembly 30 of FIGS. 47 and 48 as modified by the said ridge means 472.

The modified wing assemblies, both left and right wing assemblies, as disclosed provide a significant preformed airfoil configuration therein, as generally depicted in FIG. 52 with the result that enhanced air flow lift forces thereon are realized.

However, also already mentioned, the leading edge 152a of the modified right wing (and leading edge 152 of the modified left wing) tend to somewhat raise above what would be its otherwise straight-line configuration, depicted by line 494 in FIG. 52, which would normally be determined by the longitudinal tension in the wing panel material 146a.

Figure 53:
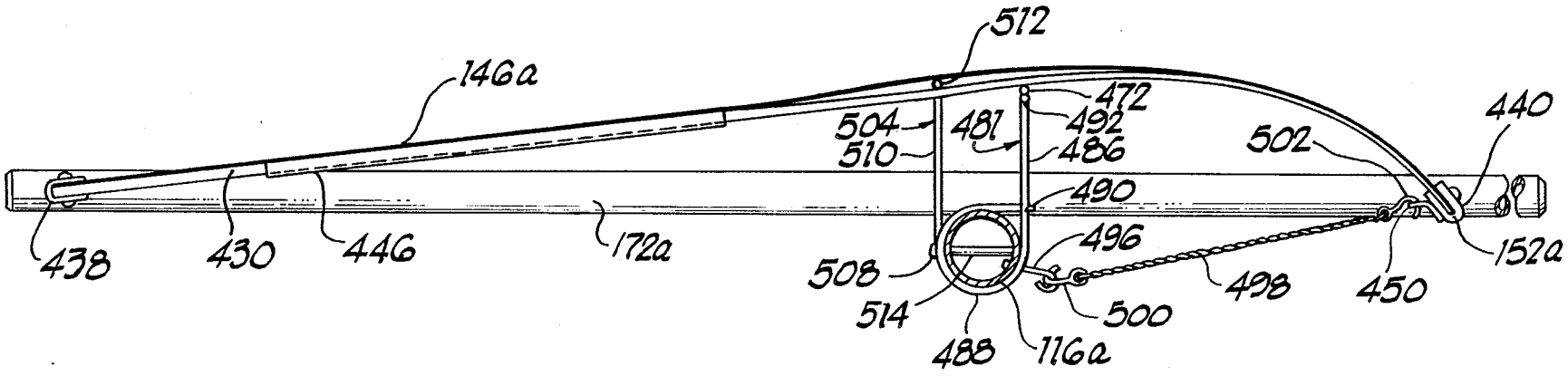
FIG. 53 is a relatively enlarged generally cross-sectional view of the wing structures of FIGS. 40 and 52 as assembled to its related ski pole shaft structure and further illustrating still another modification.

Therefore, it is contemplated that in those situations where it is desired to bring such wing leading edge 152a further generally downwardly (as viewed in FIG. 52) and thereby even further increase the airfoil curvature or camber of the wing panel assembly, provision is made for forcibly bending the relatively flexible end of the batten downwardly. Such provision is depicted in FIG. 53. It should be mentioned that FIG. 53 should be considered as if it arose out of a cross-section of the right wing assembly taken as at a plane somewhat outboard of the batten 430 with many of the elements of the overall wing assembly purposely not being shown merely to enhance clarity. Further, in FIG. 53, the wing panel material 146a, actually in cross-section, is illustrated simply as a heavy line. Further, the direction of view in FIG. 53 would be that looking toward the inboard end of the overall wing assembly which would be provided with its cross bars 172a operatively connected to the securing hooks, of the right hand ski pole assembly, effectively corresponding to 126, 128 of FIGS. 47 and 48.

Still referring to FIG. 53, suitable anchoring means such as a hook 496 is fixedly carried by the ski pole 116*a* and a suitable length of cord or strap 498, which may be provided with hook or latching means 500 and 502 at respective ends thereof, is detachably secured to anchor 496, as by latching means 500, and to member 450, as by latching means 502, thereby flexibly drawing the forward portion of the wing into a greater camber and bringing the leading edge 152*a* into a position depicted by line 494 of FIG. 52 or, if desired, some degree above or below such line 494. Member 450 may be of any suitable material and, in fact, might be made of a length of nylon or other suitable material provided as with appropriate grommets. In the preferred arrangement, such wing airfoil camber altering means, as comprised by anchor means 496 and tensioning means 498 and 450, would be provided for each batten location. It is of course apparent that the said tensioning means may be of adjustable length thereby enabling the skier to readily select the desired degree of camber alteration.

It has also been discovered that at times the lifting force on the wing panel material becomes great enough as to cause an undesirable upward bowing of the wing panel material. Accordingly, a further modification is contemplated whereby such undesired upward lifting of the wing panel material and upward movement of the battens, off of the ridge means 472 is greatly minimized if not totally eliminated. Such further modification will best be understood by reference to FIGS. 47, 48, 50 and 53.

First referring to FIG. 48, a plurality of hook-like latching means 504 and 506 are pivotally secured to the ski pole 116. As typically illustrated by the latching means 504 in FIGS. 50 and 51, each of such latching means 504, 506 may be comprised of a body portion 508 having a swingable shank portion 510 extending therefrom and terminating in a hook portion 512. A screw or bolt-like pivot member 514 may extend through body portion 508 and ski pole 116 as to be secured as by a cooperating nut or the like 516.

As generally depicted in FIGS. 50, 51 and 53, when the wing panel assembly is assembled (into its wing structure configuration) with its related ski pole assembly, the battens (as previously mentioned) engage the ridge means 472. The latching means 504 and 506 are then each rotated (as from the disengaged position fragmentarily depicted in FIG. 50 in phantom line) causing the hook portion 512 to pass generally between the wing panel material (146 or 146*a*) and the related batten member (430*b* or 430). When in a position as typically and generally depicted in FIGS. 50, 51 and 53, the latching means, such as 504, is effectively locked to its related batten and holds such batten against the ridge means 472 thereby preventing it from lifting off of ridge means 472 due to aerodynamic lifting forces.

FIGS. 47, 48, 50 and 51 illustrate a still further contemplated modification. As was described with reference to FIGS. 3, 15 and 16, the invention provides for the skier to be able to wind the wing panels about the ski poles and still use such ski poles for conventional skiing. The modified wing panel assemblies, as of FIGS. 40 and 46, even though provided with battens may still be rolled about and onto the associated ski poles, without the need for removal of the battens, because in the preferred arrangement the battens, in their free state, are generally flat and the direction of roll of the wing panel about and onto the associated ski pole is such as to cause the battens to be generally parallel to the ski pole (116 or 116*a*). However, in order to minimize the number of coiled turns of the wing panels, whether of modified form as in FIGS. 40 and 46 or of non-modified form as in FIG. 13 and 15, it is contemplated that a pair of relatively small diameter rods or wires 518 and 520 generally parallel to each other and to the ski pole 116 be provided as to be spaced from each other and from the ski pole 116. Such rods or wires 518 and 520, in turn, are held in such spaced relationship as by a plurality of U-shaped spacer supports 522, 524, 526, 528 and 530. As illustrated in greater detail in FIGS. 50 and 51, and typically by support 528, each of such supports may be comprised of opposite legs 532 and 534 joined by a semi circular bight portion 536 which is conformed to the ski pole 116. The ends 538 and 540 of legs 532 and 536 may be bent and respectively secured to the wires or stringers 520 and 518 as by, for example, welding. Further, in the preferred form of such modification, the legs 532 and 534 of each of the supports (522–530) may be braced as by any suitable interconnecting bracing means, typically depicted at 542, and effectively spanning the distance between such legs 532 and 534. Additional generally laterally extending bracing means may also be provided as to structurally interconnect the wire means 518 and 520 as generally depicted at 544 of FIG. 51. It is preferred that such bracing means 544 be comprised of a plurality of spaced lateral bracing means spaced along the longitudinal length of wire means 518. The bracing means 542 and 544 may be of any suitable kind and configuration and may be mechanically clamped to the associated structure or cemented or welded. However, in any event, and as should be apparent, whatever form of bracing means is employed, it is preferred that such be of light weight and of a size and configuration minimizing resistance to air flow therepast when the skier is using the wing structures. The supports 522–530 may be operatively fixedly secured to the ski pole 116 by any suitable means and it is contemplated that such may be achieved as by the use of epoxy and tape generally enveloping the bight portion 536, the ski pole 116, in the area of the related support, and portions of the legs 532 and 534.

The modification as depicted by members 518 and 520, along with the structure associated therewith and described herein, in effect provides for a more oval like shape to the overall ski pole when viewed axially. This, in turn, means that when the wing panel assembly, of any of FIGS. 13, 15, 40 or 46 is wound onto such a modified ski pole, in order to achieve a stored condition as generally depicted in FIGS. 3 or 16, a lesser number of coiled turns of such wing panel assembly will be required as compared to the number of coiled turns onto the ski pole of either FIGS. 10 or 15.

The various modifications have been shown, in certain instances, as they would apply to either the left hand or right hand ski pole, the left hand or right hand wing panel assembly, or the left or right wing assemblies. However, it should be clear that where obviously appropriate, the various modifications would be employed on both the right and left assemblies or components and that, generally, the right and left corresponding components, subassemblies or assemblies would be mirror images of each other.

Although only preferred embodiments of various modifications of the invention have been disclosed and described, it is apparent that other embodiments, and modifications, of the invention are possible within the scope of the appended claims.

What is claimed is:

1. Apparatus for creating aerodynamic lift to a downhill skier, comprising harnes means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, and wherein each of said left and right wing structures comprises additional means for mechanically imparting an airfoil configuration to each of said left and right wing structures.

2. Apparatus for creating aerodynamic lift to a downhill skier according to claim 1 wherein said additional means comprises batten means carried by said left and right wing structures.

3. Apparatus for creating aerodynamic lift to a downhill skier according to claim 2 wherein said batten means are substantially flat when in a normal free state.

4. Apparatus for creating aerodynamic lift to a downhill skier according to claim 2 wherein said batten means comprise a plurality of generally elongated batten members, wherein at least certain of said batten members are comprised of flexible material, and wherein the degree of flexibility varies as along the length of said certain of said batten members.

5. Apparatus for creating aerodynamic lift to a downhill skier according to claim 2 wherein said batten means are carried by said left and right wing structures at the underside of each of said left and right wing structures.

6. Apparatus for creating aerodynamic lift to a downhill skier according to claim 2 wherein said left wing structure comprises longitudinally extending first shaft means having functional first and second end portions, a first wing panel of flexible material having first inboard and first outboard ends and having first leading and first trailing edges, wherein said first wing panel is operatively connected to said first shaft means as to have said first inboard end at least near said first end portion and said first outboard end at least near said second end portion, wherein at least a first of said batten means is carried by said first wing panel as to extend generally transversely of said first wing panel and generally transversely of said first leading and first trailing edges, wherein said right wing structure comprises longitudinally extending second shaft means having functional third and fourth end portions, a second wing panel of flexible material having second inboard and second outboard ends and having second leading and trailing edges, wherein said second wing panel is operatively connected to said second shaft means as to have said second inboard end at least near said third end portion and said second outboard end at least near said fourth end portion, and wherein at least a second of said batten means is carried by said second wing panel as to extend generally transversely of said second wing panel and generally transversely of said second leading and second trailing edges.

7. Apparatus for creating aerodynamic lift to a downhill skier according to claim 6 wherein said batten means are substantially flat when in a normal free state.

8. Apparatus for creating aerodynamic lift to a downhill skier according to claim 6 wherein said batten means comprise a plurality of generally elongated batten members, wherein at least certain of said batten members are comprised of flexible material, and wherein the degree of flexibility varies as along the length of said batten members so that relatively greater flexibility exists in the portions of said batten members approaching said first and second leading edges.

9. Apparatus for creating aerodynamic lift to a downhill skier according to claim 6 wherein said first of said batten means is carried by said first wing panel at the underside thereof, and wherein said second of said batten means is carried by said second wing panel at the underside thereof.

10. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure s to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and ring wing structures to be respectively rotatable about said first and second axes independently of each other by said skier to respective selected positions while operatively carried by said harness means, wherein said connecting means is effective for establishing and maintains a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein each of said left and right wing structures comprises additional means for mechanically imparting an airfoil configuration to each of said left and right wing structures, wherein said additional means comprises batten means carried by said left and right wing structures, wherein said left wing structure comprises longitudinally extending first shaft means having functional first and second end portions, a first wing panel of flexible material having first inboard and first outboard ends and having first leading and first trailing edges, wherein said first wing panel is operatively connected to said first shaft means as to have said first inboard end at least near said first end portion and said first outboard end at least near said second end portion, wherein at least a first of said batten means is carried by said first wing panel as to extend generally transversely of said first wing panel and generally transversely of said first leading and first trailing edges, wherein said first wing structure comprises longitudinally extending second shaft means having functional third and fourth end portions, a second wing panel of flexible material having second inboard and second outboard ends and having second leading and trailing edges, wherein said second wing panel is operatively connected to said second shaft means as to have said second inboard end at least near said third end portion and said second outboard end at least near said fourth end portion, wherein at least a second of said batten means is carried by said second wing panel as to extend generally transversely of said second wing panel and generally transversely of said second leading and second trailing edges, wherein said batten means comprise a plurality of elongated batten members each having first and second batten ends, and further comprising first and second batten-end retainer means, wherein said first and second retainer means are carried by both said first and second wing panels, and wherein said first and second batten ends are respectively retained by said first and second retainer means.

11. Apparatus for creating aerodynamic lift to a downhill skier according to claim 10 wherein said first retainer means are carried by said first and second wing panels as to be at least near said first and second leading edges thereof.

12. Apparatus for creating aerodynamic lift to a downhill skier according to claim 10 wherein said second retainer means are carried by said first and second wing panels as to be at least near said first and second trailing edges thereof.

13. Apparatus for creating aerodynamic lift to a downhill skier according to claim 10 and further comprising means for positively limiting the amount which at least certain of said plurality of batten members are permitted to bow due to the aerodynamic lifting force experienced by said first and second wing panels.

14. Apparatus for creating aerodynamic lift to a downhill skier according to claim 13 wherein said means for positively limiting the amount of bow comprises latching means, said latching means being effective to mechanically interconnect said at least certain of said batten members respectively to said first and second shaft means.

15. Apparatus for creating aerodynamic lift to a downhill skier according to claim 14 wherein said latching means is carried by said first and second shaft means and manually operatively engageable with said certain of said batten members.

16. Apparatus for creating aerodynamic lift to a downhill skier according to claim 15 wherein said latching means comprises a hook-like member pivotally secured at a first end to one of said first and second shaft means and carrying a hook-like portion at a second end, and wherein said hook-like portion is operatively engageable with said certain of said batten members by extending generally between said certain of said batten members and said flexible material of the related one of said first and second wing panels.

17. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structure to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein each f said left and right wing structures comprises additional means for mechanically imparting an airfoil configuration to each of said left and right wing structures, wherein said additional means comprises batten means carried by said left and right wing structures, wherein said left wing structure comprises longitudinally extending first shaft means having functional first and second end portions, a first wing panel of flexible material having first inboard and first outboard ends and having first leading and first trailing edges, wherein said first wing panel is operatively connected to said first shaft means as to have said first inboard end at least near said shaft end portion and said first outboard end at least near said second end portion, wherein at least a first of said batten means is carried by said first wing panel as to extend generally transversely of said first wing panel and generally transversely of said first leading and first trailing edges, wherein said right wing structure comprises longitudinally extending second shaft means having functional third and fourth end portions, a second wing panel of flexible material having second inboard and second outboard ends and having second leading and trailing edges, wherein said second wing panel is operatively connected to said second shaft means as to have said second inboard end at least near said third end portion and said second outboard end at least near said fourth end portion, wherein at least a second of said batten means is carried by said second wing panel as to extend generally transversely of said second wing panel and generally transversely of said second leading and second trailing edges, and further comprising camber forming means, said camber forming means being operatively connected to said first and second leading edges to forcibly flex that portion of said batten means nearer said first and second leading edges and thereby move said first and second leading edges downstream and increase the degree of camber of said first and second wing panels.

18. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein each of said left and right wing structures comprises additional means for mechanically imparting an airfoil configuration to each of said left and right wing structures, wherein said additional means comprises batten means carried by said left and right wing structures, and further comprising longitudinal extending first shaft means, longitudinally extending second shaft means, wherein said first shaft means comprises said first longitudinal axis, wherein said second shaft means comprises said second longitudinal axis, and wherein said additional means comprises first and second abutment means, wherein said first abutment means is operatively carried by said first shaft means, wherein said second abutment means is operatively carried by said second shaft means, and wherein said first and second abutment means operatively engage at least certain of said batten means so as to cause said certain of said batten means to become bowed into an airfoil configuration.

19. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein said harness means comprises a substantially rigid breast plate member intended to be worn against a forward portion of said skier's torso, attachment means for securingly holding said breast plate member against said forward portion of said skier's torso, wherein said attachment means comprises first and second flexible strap means, wherein said first flexible strap means is intended for securing engagement with the skier's left leg, wherein said second flexible strap means is intended for securing engagement with the skier's right leg, and resilient means operatively connected to said first and second flexible strap means, said resilient means being effective to resiliently elongate the length of said first and second flexible strap means when in securing engagement with the skier's left and right legs to yieldingly accommodate relative movement of the skier's left and right legs.

20. Apparatus for creating aerodynamic lift to a downhill skier according to claim 19 wherein said resilient means comprises a resilient connection between said first and second flexible strap means and said breast plate member.

21. Apparatus for creating aerodynamic lift to a downhill skier according to claim 20 wherein said resilient connection comprises spring means operatively engaged to a first end of said first flexible strap means and to a first end of said second flexible strap means.

22. Apparatus for creating aerodynamic lift to a downhill skier, comprises harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, while said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein said harness means comprises a substantially rigid breast plate member intended to be worn against a forward portion of said skier's torso, attachment means for securingly holding said breast plate member against said forward portion of said skier's torso, wherein said attachment means comprises first and second flexible strap means, wherein said first flexible strap means is intended for securing engagement with the skier's left leg, wherein said second flexible strap means is intended for securing engagement with the skier'right leg, resilient means operatively connected to said first and second flexible strap means, said resilient means being effective to resiliently elongate the length of said first and second flexible strap means when in securing engagement with the skier's left and right legs to yieldingly accomodate relative movement of the skier's left and right legs, and further comprising first and second lever means pivotally secured to said breast plate member, wherein an end of said first flexible strap means is operatively connected to said first lever means, wherein an end of said second flexible strap means is operatively connected to said second lever means, wherein said resilient means comprises spring means, and wherein said first and second lever means are operatively connected to said spring means as to be yieldingly urged in a pivotal motion thereby.

23. Apparatus for creating aerodynamic lift to a downhill skier according to claim 22 wherein said spring means comprises a spring member having a first end thereof operatively connected to said first lever means and having a second end thereof operatively connected to said second lever means.

24. Apparatus for creating aerodynamic lift to a downhill skier according to claim 23 and further comprising first and second bending structures, wherein said first bending structure is associated with said first lever means, wherein said second bending structure is associated with said second lever means, wherein said spring member engages both of said first and second bending structures, wherein when said first lever means pivots in a direction causing an increasing resilient resisting force in said spring member a portion of said spring member is bent against said first bending structure, and wherein when said second lever means pivots in a direction causing an increasing resilient resisting force in said spring member another portion of said spring member is bent against said second bending structure.

25. Apparatus for creating aerodynamic lift to a downhill skier according to claim 19 wherein said attachment means further comprises third and fourth flexible shoulder strap means each of which is operatively connected to said rigid breast plate member, wherein said third and fourth shoulder strap means respectively engage the left and right shoulders of said skier, flexible girding type strap means operatively connected to said rigid breast plate member and generally passing around the back of said skier's torso at least in the vicinity of said skier's waist, and wherein said first and second flexible strap means at respective ends thereof are operatively connected to said rigid breast plate member by being directly connected to said girding type strap means.

26. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis,,wherein said connecting means comprises journal means and resilient means, wherein said journal means is effective to rotatably support said left and right wing structures so that said left and right wing structures are respectively rotatable about said first and second axes independently of each other by said skier, wherein said resilient means is resiliently deflectable in at least two directions of motion, wherein when said left wing structure is selectively rotated on said journal means in a first direction about said first longitudinal axis said resilient means resiliently urges said left wing structure in a second direction on said journal means opposite to said first direction and about said first longitudinal axis, and wherein when said right wing structure is selectively rotated on said journal means in a first direction about said second longitudinal axis said resilient means resiliently urges said right wing structure in a second direction on said journal means about said second longitudinal axis opposite to said first direction about said second longitudinal axis.

27. Apparatus for creating aerodynamic lift to a downhill skier according to claim 26 wherein said journal means is at least in part of cylindrical configuration, and wherein said journal means applies no resilient rotational forces on either of said wing structures about either of said longitudinal axes.

28. Apparatus for creating aerodynamic lift to a downhill skier according to claim 27 wherein said resilient means comprises torsion bar means.

29. Apparatus for creating aerodynamic lift to a downhill skier according to claim 28 wherein said journal means is of tubular configuration, wherein said torsion bar means is situated generally internally of said tubular configuration, wherein a general mid-portion of said tubular configuration is deformed to form a flattened portion against a corresponding general mid-portion of said torsion bar means, and wherein said flattened portion serves as anchoring means against which said torsion bar means torsionally rotates.

30. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein said left wing structure comprises a first outboard end and a first inboard end with said first inboard end being effective to be operationally situated relatively closer to said harness means than said first outboard end, wherein said left wing structure comprises manually engageable first control means situated at least near said first inboard end and engageable by the skier's left hand in order to thereby selectively rotate said left wing structure about said first longitudinal axis, wherein said right wing structure comprises a second outboard end and a second inboard end with said second inboard end being effective to be operationally situated relatively closer to said harness means than said second outboard end, wherein said right wing structure comprises manually engageable second control means situated at least near said second inboard end and engageable by the skier's right hand in order to thereby selectively rotate said right wing structure about said second longitudinal axis, and further comprising first and second fence-like abutment means, wherein said first fence-like abutment means is situated at least near said first inboard end and engageable by the skier's left forearm in order to thereby urge said left wing structure along said first longitudinal axis and toward said harness means, and wherein said second fence-like abutment means is situated at least near said second inboard end and engageable by the skier's right forearm in order to thereby urge said right wing structure along said second longitudinal axis and toward said harness means.

31. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein said left wing structure comprises longitudinally extending first ski pole shaft means, wherein said right wing structure comprises longitudinally extending second ski pole shaft means, wherein said first ski pole shaft means carries generally longitudinally extending first eccentric abutment means spaced from said first ski pole shaft means, wherein said second ski pole shaft means carries generally longitudinally extending second eccentric abutment means spaced from said second ski pole shaft means, wherein said left wing structure comprises a left wing panel of flexible material, wherein said right wing structure comprises a right wing panel of flexible material, and wherein when said left wing panel of flexible material and said right wing panel of flexible material when disengaged from their operative conditions are able to be respectively coiled about said first ski pole shaft means and first eccentric abutment means and coiled about said second ski pole shaft means and second eccentric abutment means.

32. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein each of said left and right wing structures comprises additional means for mechanically imparting an airfoil configuration to each of said left and right wing structures, wherein said harness means comprises a substantially rigid breast plate member intended to be worn as against a forward portion of said skier's torso, attachment means for securingly holding said breast plate member against said forward portion of said skier's torso, wherein said attachment means comprises first and second flexible strap means, wherein said first flexible strap means is intended for securing engagement with the skier's left leg, wherein said second flexible strap means is intended for securing engagement with the skier's right leg, resilient means operatively connected to said first and second flexible strap means, said resilient means being effective to resiliently elongate the length of said first and second flexible strap means when in securing engagement with the skier's left and right legs to yieldingly accommodate relative movement of the skier's left and right legs, wherein said connecting means comprises journal means and second resilient means, wherein said journal means is effective to rotatably support said left and right wing structures so that said left and right wing structures are respectively rotatable about said first and second axes independently of each other by said skier, wherein said engageable by the skier's right hand in order to thereby selectively rotate said right wing structure about said second longitudinal axis, and further comprising first and second fence-like abutment means, wherein said first fence-like abutment means is situated at least near said first inboard end and engageable by the skier's left forearm in order to thereby urge said left wing structure along said first longitudinal axis and toward said harness means, and wherein said second fence-like abutment means is situated at least near said second inboard end and engageable by the skier's right forearm in order to thereby urge said right wing structure along said second longitudinal axis and toward said harness means, wherein said left wing structure comprises longitudinally extending first ski pole shaft means, wherein said right wing structure comprises longitudinally extending second ski pole shaft means, wherein said first ski pole shaft means carries generally longitudinally extending first eccentric abutment means spaced from said first ski pole shaft means, wherein said second ski pole shaft means carries generally longitudinally extending second eccentric abutment means spaced from said second ski pole shaft means, wherein said left wing structure comprises a left wing panel of flexible material, wherein said right wing structure comprises a right wing panel of flexible material, and wherein when said left wing panel of flexible material and said right wing panel of flexible material when disengaged from their operative conditions are able to be respectively coiled about said first ski pole shaft means and first eccentric abutment second resilient means is resiliently deflectable in at least two directions of motion, wherein when said left wing structure is selectively rotated on said journal means in a first direction about said first longitudinal axis said second resilient means resiliently urges said left wing structure in a second direction on said journal means opposite to said first direction and about said first longitudinal axis, wherein when said right wing structure is selectively rotated on said journal means in a first direction about said second longitudinal axis said second resilient means resiliently urges said right wing structure in a second direction on said journal means about said second longitudinal axis opposite to said first direction about said second longitudinal axis, wherein said left wing structure comprises a first outboard end and a first inboard end with said first inboard end being effective to be operationally situated relatively closer to said harness means than said first outboard end, wherein said left wing structure comprises manually engageable first control means situated at least near said first inboard end and engageable by the skier's left hand in order to thereby selectively rotate said left wing structure about said first longitudinal axis, wherein said right wing structure comprises a second outboard end and a second inboard end with said second inboard end being effective to be operationally situated relatively closer to said harness means than said second outboard end, and wherein said right wing structure comprises manually engageable second control means situated at least near said second inboard end and means and coiled about said second ski pole shaft means and second eccentric abutment means.

33. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said right and second axes independently of each other by said skier to respectively selected positions while operatively carried by said harness means, wherein said connecting means is effective for establishing and maintaining a fixed relationship of said first longitudinal axis with respect to said harness means even during rotation of said left wing structure about said first longitudinal axis, wherein said connecting means is effective for establishing and maintaining a fixed relationship of said second longitudinal axis with respect to said harness means even during rotation of said right wing structure about said second longitudinal axis, wherein each of said left and right wing structures is configured as to define an airfoil configuration in each of said left and right wing structures, and wherein said airfoil configuration in each of said wing structures exists even without the flow of air past said wing structures.

34. Apparatus for creating aerodynamic lift to a downhill skier according to claim 1 and comprising further means for manually selectively adjustment the camber of said airfoil configuration in each of said wing structures.

35. Apparatus for creating aerodynamic lift to a downhill skier according to claim 18 wherein said first abutment means comprises a first longitudinally extending member carried by said first shaft means as to be eccentrically disposed relative to said first shaft means, and wherein said second abutment means comprises a second longitudinal extending member carried by said second shaft means as to be eccentrically disposed relative to said second shaft means.

36. Apparatus for creating aerodynamic lift to a downhill skier according to claim 18 and further comprising means for operatively engaging and effectively urging at least certain of said batten members toward said first and second abutment means.

37. Apparatus for creating aerodynamic lift to a downhill skier according to claim 24 wherein said first bending structure comprises a first drum-like body rotatable about its axis and carrying said first lever means, and wherein said second bending structure comprises a second drum-like body rotatable about its axis and carried said second lever means.

* * * * *